US005741185A

United States Patent [19]

Kwan et al.

[11] Patent Number: 5,741,185

[45] Date of Patent: Apr. 21, 1998

[54] INTERACTIVE LIGHT-OPERATED TOY SHOOTING GAME

[75] Inventors: David Chu Ki Kwan, Hong Kong, Hong Kong; Steven Lebensfeld, Laurel Hollow, N.Y.; Carmine Russo, West Islip, N.Y.; Frank Landi, Great Neck, N.Y.; Ng Wing Kwong, Hong Kong, Hong Kong

[73] Assignee: Toymax Inc., Plainview, N.Y.

[21] Appl. No.: 795,895

[22] Filed: Feb. 5, 1997

[51] Int. Cl.[6] ..... F41J 5/02; A63F 9/02

[52] U.S. Cl. ..... 463/51; 463/52; 463/53; 434/22; 434/24; 446/175; 446/406; 446/437; 446/443

[58] Field of Search ..... 463/2, 5, 50–52, 463/56, 30–31, 36, 39; 446/175, 397, 401, 404, 405, 406, 473, 436, 437, 441, 442, 443, 465; 434/20–22, 24, 307 R; 364/410, 411

[56] References Cited

U.S. PATENT DOCUMENTS

| | | |
|---|---|---|
| 3,220,732 | 11/1965 | Pincus . |
| 3,499,650 | 3/1970 | Lemelson . |
| 3,870,305 | 3/1975 | Harclerode . |
| 3,995,376 | 12/1976 | Kimble et al. . |
| 4,164,081 | 8/1979 | Berke . |
| 4,171,811 | 10/1979 | Meyer et al. . |
| 4,266,776 | 5/1981 | Goldfarb . |
| 4,267,606 | 5/1981 | Stelter et al. . |
| 4,375,106 | 2/1983 | Voll . |
| 4,426,662 | 1/1984 | Skerlos et al. . |
| 4,586,715 | 5/1986 | Scolari et al. . |

(List continued on next page.)

OTHER PUBLICATIONS

Worlds of Wonder Laser tag Description in IDS dated Nov. 21, 1997.

Panosh Laser Combat Description in IDS dated No. 21, 1997.

LJN/Entertech Photon Description in IDS dated Nov. 21, 1997.

Golub Laser Pro 9000 Description in IDS dated Nov. 21, 1997.

Hasbro Survivor Shot Description in IDS dated Nov. 21, 1997.

*Primary Examiner*—Jessica Harrison
*Assistant Examiner*—Mark A. Sager
*Attorney, Agent, or Firm*—Cowan, Liebowitz & Latman, P.C.

[57] ABSTRACT

The invention provides a toy light projector or light gun and player-worn and self-propelled toy targets which detect light emitted by a toy light gun, and a toy shooting game which includes at least one toy light gun, and at least one toy target. The game is played by a player attempting to "hit" a target which provides audio/visual effects upon detecting light projected by the gun. A main target contains a light detector and all of the circuitry and audio/visual components needed to play a game, and an auxiliary target may contain a light detector and only some of the components needed to play a game and be coupled to a main target to share components therein. A self-propelled target includes circuitry which provides pseudorandom (or other pre-programmed or random) motion to the target. The light gun emits a sound while it is on and ready to be fired, which can serve as a warning to an opposing player. Squeezing a trigger causes the gun to emit light with a first code, and pressing a reset button causes the gun to emit light with a second code. The circuitry in a target decodes the codes and registers and counts hits for light detected with the first code, ending the game when a given number of hits is counted. In response to light detected with the second code, the circuitry in a target resets the count of hits and starts a new game. The gun can thus remotely reset the target. The gun has a reload feature which requires that a player "reload" the gun (press a reload button) after a given number of shots. A target may be provided with an adjustable optical system which affects the reception and/or detection of light projected from a light gun and thereby change the difficulty level of the game.

39 Claims, 13 Drawing Sheets

U.S. PATENT DOCUMENTS 4,629,427 12/1986 Gallagher .
4,754,133 6/1988 Bleich .
4,781,593 11/1988 Birge et al. .
4,802,675 2/1989 Wong et al. .
4,898,391 2/1990 Kelly et al. .
4,931,028 6/1990 Jaeger et al. .
5,029,872 7/1991 Sassak .
5,253,068 10/1993 Crook et al. ..... 446/406
5,375,847 12/1994 Fromm et al. .
5,437,463 8/1995 Fromm .
5,552,917 9/1996 Darbee et al. .
5,577,962 11/1996 Kounoe et al. .
5,656,907 8/1997 Chainani et al. ..... 446/436

INTERACTIVE LIGHT-OPERATED TOY SHOOTING GAME

BACKGROUND OF THE INVENTION

The invention disclosed herein relates to an interactive toy shooting game played by radiating energy, e.g., light, and detecting appropriately directed radiated energy. More particularly, the game includes a light emitter which may be configured as some type of gun and a radiation detector which may configured as a target carried by another player or by a self-propelled or stationary device. The game provides audio and/or visual effects associated with one or more of the following: radiating energy; detecting radiated energy ("hits") shot from a radiation emitter; and activating selected game functions.

Toy shooting games played by shooting some form of light and detecting when the shot light strikes a target typically include a light emitter and a light detector. The light detector may be located with the target and detect light impinging on the target, or the light detector may be provided with the light emitter to detect light reflected from a reflector provided with the target. Many remote control applications, including remote control of consumer electronics devices and toys, use transmitted and detected light. Some of the above toys and remote control applications disclose pulsing, modulating and/or coding the light, which may be infrared light. See, for example, U.S. Pat. Nos. 3,499,650, 4,171,811, 4,267,606, 4,586,715, 4,754,133, 4,802,675, 4,375,106, 4,426,662, 4,931,028, 5,029,872, 5,375,847 and 5,552,917.

OBJECTS AND SUMMARY OF THE INVENTION

It is an object of the invention disclosed herein to provide a toy shooting game with enhanced play value.

It is another object of the invention to provide a toy shooting game with novel game features.

It is another object of the invention to provide a toy shooting game which projects and detects radiated energy, e.g., light, that has improved range and which works well in bright daylight.

It is another object of the invention to provide a toy shooting game comprising a toy gun which radiates energy and a toy target which detects the energy radiated by the gun, in which the target counts hits, ends a game after a predetermined number of hits and in which the gun can remotely reset the target to start a new game.

It is another object of the invention to provide a toy shooting game comprising a toy gun which radiates energy and a toy target which detects the energy radiated by the gun in which the level of difficulty of the game can be adjusted.

It is an object of the invention to provide a toy shooting game in which interaction of two or more targets are linked.

It is another object of the invention to provide a toy shooting game with enhanced audio and/or visual effects.

It is another object of the invention to provide a self-propelled target whose motion is practically unpredictable during a game.

The above and other objects are achieved by the invention disclosed herein, which comprises, individually and in combination, a toy energy radiator and a toy energy receptor or detector having the structures described herein and equivalents thereof which perform the functions described herein and equivalents thereof. In the preferred embodiments, light energy is used. However, other forms of appropriate radiated energy may be used to achieve functions described herein, and the invention is intended to encompass such other forms of radiated energy, such as electro-magnetic and sound energy. Light energy may be any appropriate light of wave length or lengths, visible and invisible to the human eye.

The toy energy radiator and toy energy receptor or detector, and the combination thereof, have one or more of the following.

The toy energy radiator while in an active mode in which it is ready to radiate energy upon activation of a control such as a trigger emits a sound, which can serve as a warning to an opponent.

The toy energy radiator has a reload feature which requires that a player "reload" after a given number of shots, i.e., energy radiations, for example six.

The game has a remote reset feature according to which a toy energy receptor which counts hits (detected radiations) and ends the game upon a detecting a given number of hits can be remotely reset by the toy energy radiator to start a new game.

The toy energy receptor may be adjusted to affect reception and/or detection by the energy receptor of energy radiated by the toy energy radiator, and thereby adjust the level of difficulty of the game.

Main and auxiliary energy receptors may be provided in which an auxiliary energy receptor is coupled to a main energy receptor and shares with the main energy receptor one or more of the components therein.

A target may be self-propelled and include programmed circuitry and/or be constructed so as to cause the target to move unpredictably at least in the context of a game.

These and other features are described in more detail below.

As mentioned light energy is used in the preferred embodiments. Therefore, the invention is described below in connection with light energy with the intentions that the invention not be so limited, and that other forms of radiated energy may be used as well.

The invention provides a toy light projector or light gun and toy targets which detect light emitted by a toy light gun. The invention also provides an interactive toy shooting game comprising at least one toy light gun and at least one toy target.

A toy light gun incorporating the invention comprises a housing having a light transmitting aperture, a light source carried by the housing positioned to project light to and through the aperture, an electrical circuit carried by the housing coupled to the light source to energize the light source according to a preset code and thereby cause the light source to emit light according to the preset code which is projected to and through the aperture, and a first manually actuatable trigger control and a second manually actuatable control carried by the housing and coupled to the electrical circuit. Activation of the first manually actuatable control causes the toy light gun to emit light with a first code indicative of firing the toy light gun, and actuation of the second manually actuatable control causes the toy light gun to emit light with a second code. The electrical circuit controls energization of the light source according to first and second codes in response to activation of the first and second controls, respectively, to cause the light source to emit light with the first and second codes, respectively. Activation of the first trigger control causes the toy light gun to fire light with the first code which when detected by a toy target may be counted as a hit, and activation of the second control causes the toy light gun to fire light with the second code which when detected by a toy target may be used to remotely control a function associated with the toy target.

The toy light gun may also include a sound generating device carried by the housing to emit sound therefrom responsive to electrical sound signals supplied thereto in response to activation of the first and second controls. The electrical circuit in addition to controlling energization of the light source, provides first and second electrical sound signals representing first and second sounds or sequences of sounds to the sound generating device in response to activation of the first and second controls, respectively. In the preferred embodiment, the electrical circuit comprises a sound synthesizer which supplies the first and second electrical sound signals to a speaker.

In another embodiment, the toy light gun has two manually actuatable controls and the electrical circuit controls energization of the light source in response to activation of one of the controls up to a preset number of times to cause the light source to emit light having a predetermined characteristic or characteristics the preset number of times, and then does not energize the light source to emit light in response to further activations of the one control. Upon activation of the other control, the electrical circuit controls energization of the light source to emit light up to the preset number of times. For example, activation of the other control resets a count of the activations of the one control.

In the preferred embodiment, the toy light gun has the first and second controls described above, and a third control, and controls energization of the light source in response to the first and second controls as described above, and in addition controls energization of the light source in response to a preset number of activations of the first control. Activation of the third control resets the electrical circuit, which then controls energization of the light source according to the first code for the preset number of activations of the first control.

The toy light gun may also include one or more light devices connected to the electrical circuit which emit light whenever the first, second and/or third controls are activated. The pattern or sequence of emitted light may differ depending upon whether the first trigger control is activated or another control is activated, and/or the order of activation of the controls.

In the preferred embodiment, the light source emits infrared light when energized.

In the preferred embodiments, the electrical circuit comprises a modulating circuit which modulates energization of the light source during a first time period in response to activation of the first control and during a second time period in response to activation of the second control. The modulation is preferably amplitude modulation, may be a simple chopping and may be at a fixed frequency. The electrical circuit comprises a control circuit coupled to the first trigger control and the other control or controls and to the modulation circuit, the control circuit causing the modulating circuit to modulate energization of the light source during the first and second time periods.

Where the toy light gun has three controls, the control circuit causes the modulating circuit to modulate energization of the light source during the first time period for up to a preset number of activations of the first control and thereafter to not energize or modulate energization of the light source during the first time period. The third control is coupled to the control circuit, which causes the modulation circuit to modulate energization of the light source during the first time period for up to the preset number of first control activations in response to activation of the third control.

Preferably the electrical circuit includes a programmed processor which responds to activations of the controls to cause the electrical circuit to operate as described herein.

The toy light gun may also have an optical system having a lens positioned between the light transmitting aperture and the light source.

A toy target incorporating the invention comprises a housing having a light transmitting aperture, and a light detector carried by the housing positioned to receive first and second coded pulses of light which enter the aperture. The light detector detects the first and second coded pulses of light and provides first and second electrical signals, respectively, in response thereto. The toy target also includes an electrical circuit coupled to receive the first and second electrical signals provided by the light detector and count the first electrical signals, and in response to the second electrical signals provided by the light detector reset a count of the first electrical signals.

In the preferred embodiment, the light detector provides a first electrical signal in response to a first coded light pulse and a second electrical signal in response to a second coded light pulse, and the electrical circuit counts first electrical signals up to a preset number and thereafter does not count further first electrical signals until the count is reset in response to the second electrical signals.

The toy target may comprise a sound generating device carried by the housing to emit sound therefrom responsive to first and second electrical sound signals supplied thereto, and the electrical circuit generates the first electrical sound signals representing a first sound or sequence of sounds with each count of a first electrical signal, and generates the second electrical sound signal representing a second sound or sequence of sounds with each reset of the count responsive to the second electrical signals. In the preferred embodiment, the electrical circuit comprises a sound synthesizer and the sound generating device comprises a speaker.

The toy target may comprise an adjustable optical system having a plurality of adjusted configurations which affect the detection by the light detector of pulses of light which enter the aperture. For example, the length of the optical path and/or the size of the aperture may be adjusted. In the preferred embodiment, the light detector comprises an infrared light detector which detects pulses of light modulated at a given frequency. The first and second coded light pulses may have different pulse widths by which the first and second light pulses are coded, and in that case the light detector provides first and second electrical pulse signals having different pulse widths related to the pulse widths of the first and second light pulses, respectively.

The toy target may be self-propelled and comprise an electric motor and at least one wheel carried by the housing on which the housing rides and which is driven by the motor to propel the light detecting toy. Embodiments of the self-propelled toy target need not include all of the structure described above. The electrical circuit in the self-propelled toy target includes a drive circuit coupled to the motor to supply power thereto to energize the motor. The electrical motor may be reversible and the drive circuit in that case is configured and coupled to the motor to supply power thereto to cause the motor to reverse direction in accordance with a sequence controlled by the electrical circuit. The programmed processor mentioned above may provide signals to the drive circuit to effect the sequence. The self-propelled toy target may comprise a non-driven wheel on which the housing rides, the non-driven wheel being mounted to an axle. In this embodiment, the housing has a track along which the axle or at least one end thereof is free to translate. The track is non-linear, whereby the non-driven wheel affects the path of motion of the light detecting toy in response to the terrain on which the light detecting toy rides, obstacles encountered by the light detecting toy and direction reversals of the driven wheel.

In another embodiment, a toy target has a housing having a light transmitting aperture and a light detector carried by the housing positioned to receive pulses of light which enter the aperture and detect pulses of light having given characteristics and provide electrical signals in response thereto. This toy target has at least one indicator device carried by the housing coupled to receive the electrical signals and activate the indicator to thereby indicate detection by the light detecting toy of pulses of light having the given characteristics. This toy target also has an adjustable optical system positioned between the aperture and the light detector which has a plurality of adjusted configurations that affect the detection by the light detector of pulses of light having the given characteristics which enter the aperture. This toy target may also have other structure described herein for toy targets.

In still another embodiment, a combination of a main toy target and an auxiliary toy target is provided. The main toy target and the auxiliary toy target each comprise a housing having a light transmitting aperture, a light detector carried by the housing positioned to receive light entering the aperture and provide an output signal in response to received light having a predetermined characteristic or characteristics, and a connector. The main toy target further comprising an electrical circuit carried by the housing thereof coupled to the light detector of the main light detecting toy to receive and process the output signal therefrom. The connector in the main toy target is coupled to the electrical circuit and the connector in the auxiliary toy target is coupled to receive the output signal of the light detector in the auxiliary toy target. A conductor connected to the connectors couples the output signal of the light detector in the auxiliary toy target to the electrical circuit in the main toy target.

Only the main toy target may be provided with a battery which is coupled to the connector of the main toy target space. Also, only the main toy target may be provided with a speaker coupled to the connector of the main toy target. A conductor coupled to the connectors couples the battery in the main toy target to the auxiliary toy target, and a conductor coupled to the connectors couples the speaker in the auxiliary toy target to the electrical circuit in the main toy target. Both the main and auxiliary toy targets may be provided with light sources which are controlled by the electrical circuit in the main toy target. The connector in the main toy target is also coupled to the light source control output, and the light source of the auxiliary toy target is coupled to the connector thereof, with a conductor connected to the connectors coupling the light source control output of the electrical circuit of the main toy target to the light source of the auxiliary toy target.

The invention also comprises the combination of a toy light gun and at least one target to provide an interactive shooting game. Players may be equipped with a toy light gun and one or more toy targets, or a single player equipped with a toy light gun may interact with a single target which may be self-propelled. Interactivity is provided by a player shooting at a target, either carried by another player, or a self-propelled target, or a stationary target which registers and indicates hits, and/or is remotely resettable, and/or requires reloading of the light gun after a given number of shots, and/or in which the toy light gun emits sounds whenever it is ready for firing, etc., as described herein.

BRIEF DESCRIPTION OF THE DRAWINGS

The invention is illustrated in the figures of the accompanying drawings which are meant to be exemplary and not limiting, in which like numerals in the different figures refer to like or corresponding parts, and in which.

Figure 1:
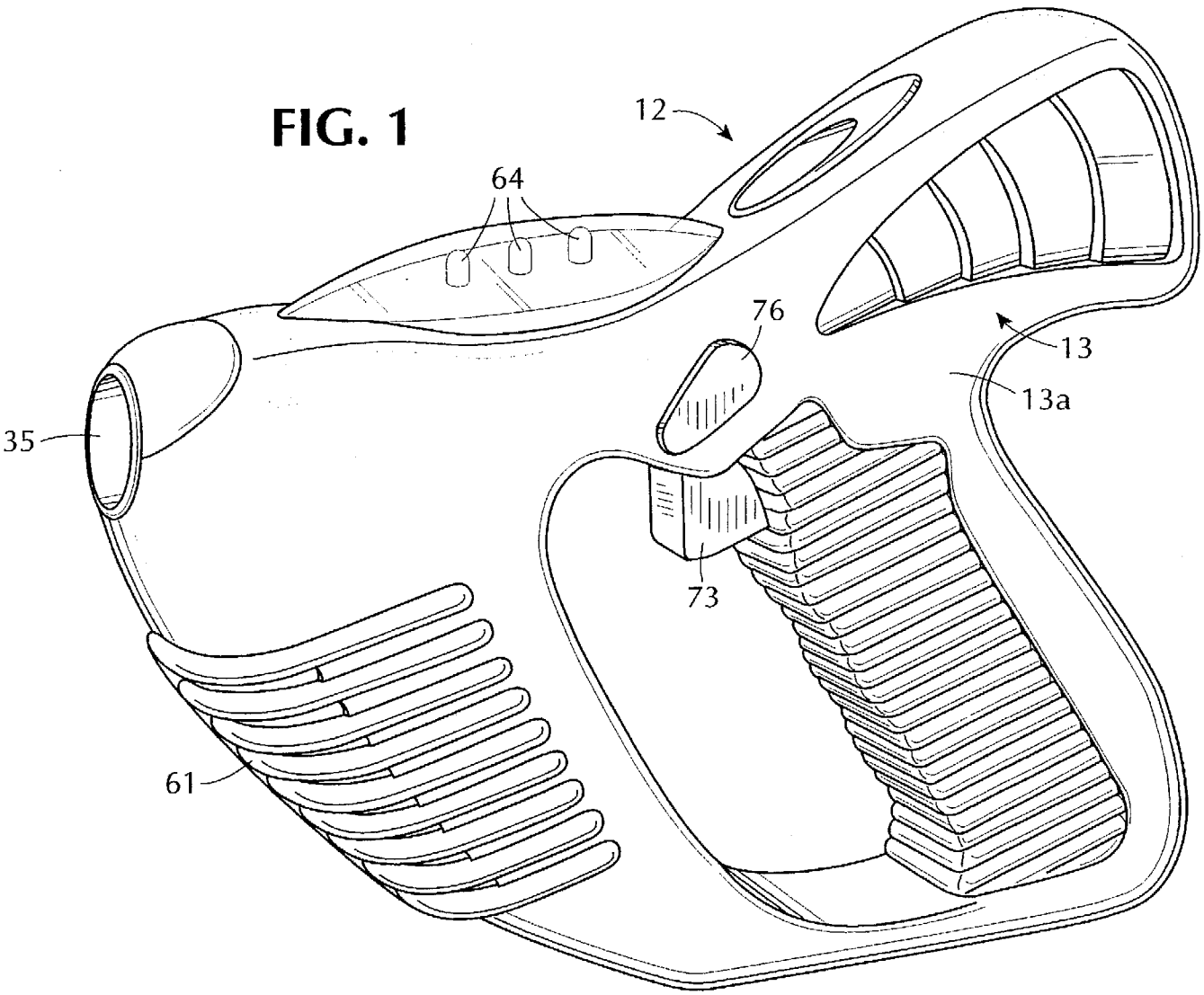
FIG. 1 is a perspective view of a toy light projector or light gun incorporating the invention configured as a futuristic toy "ray" gun.
Figure 4:
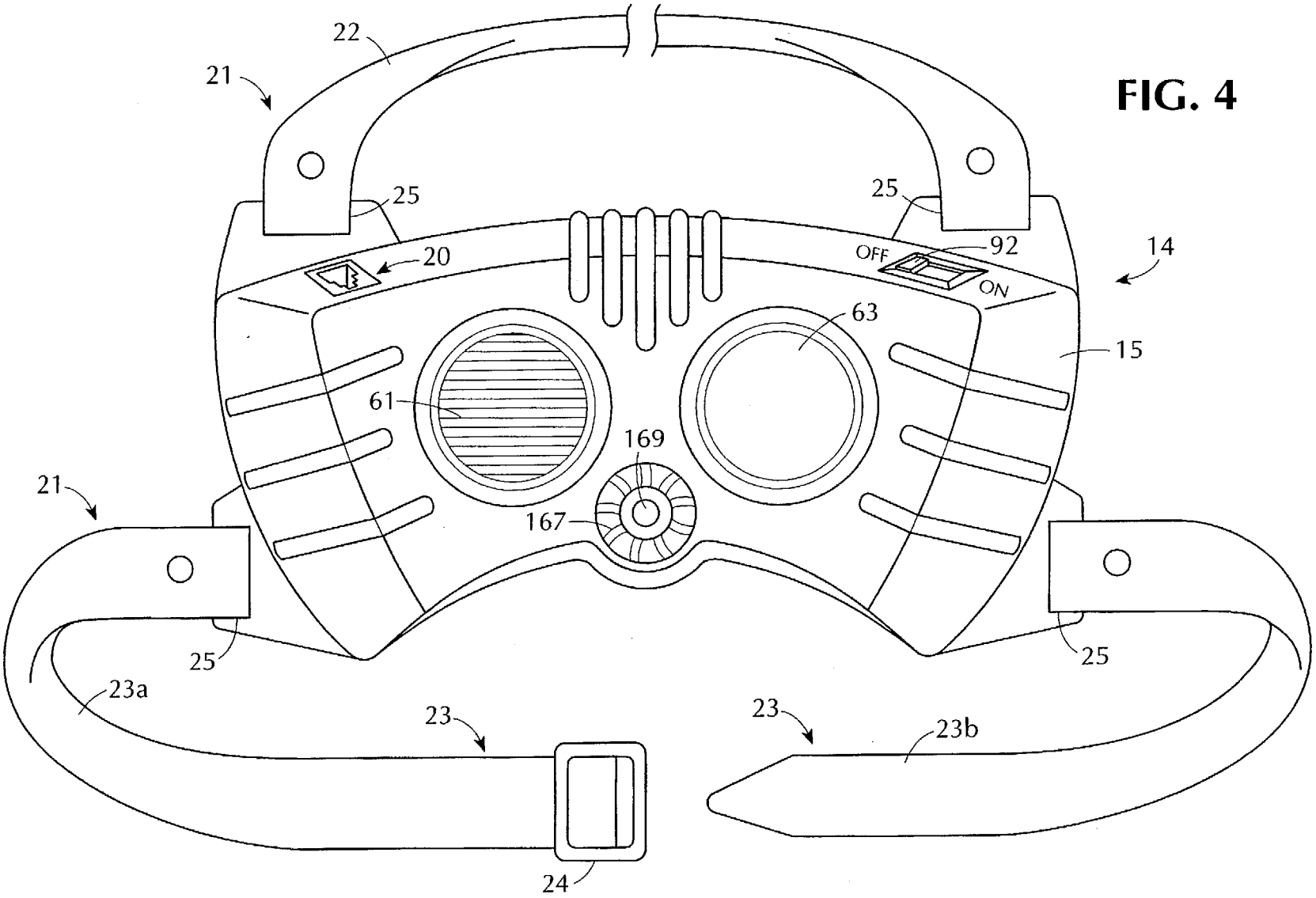
FIG. 4 is a perspective view of a player-worn target which responds to light from the toy light gun depicted in FIG. 1.
Figure 6:
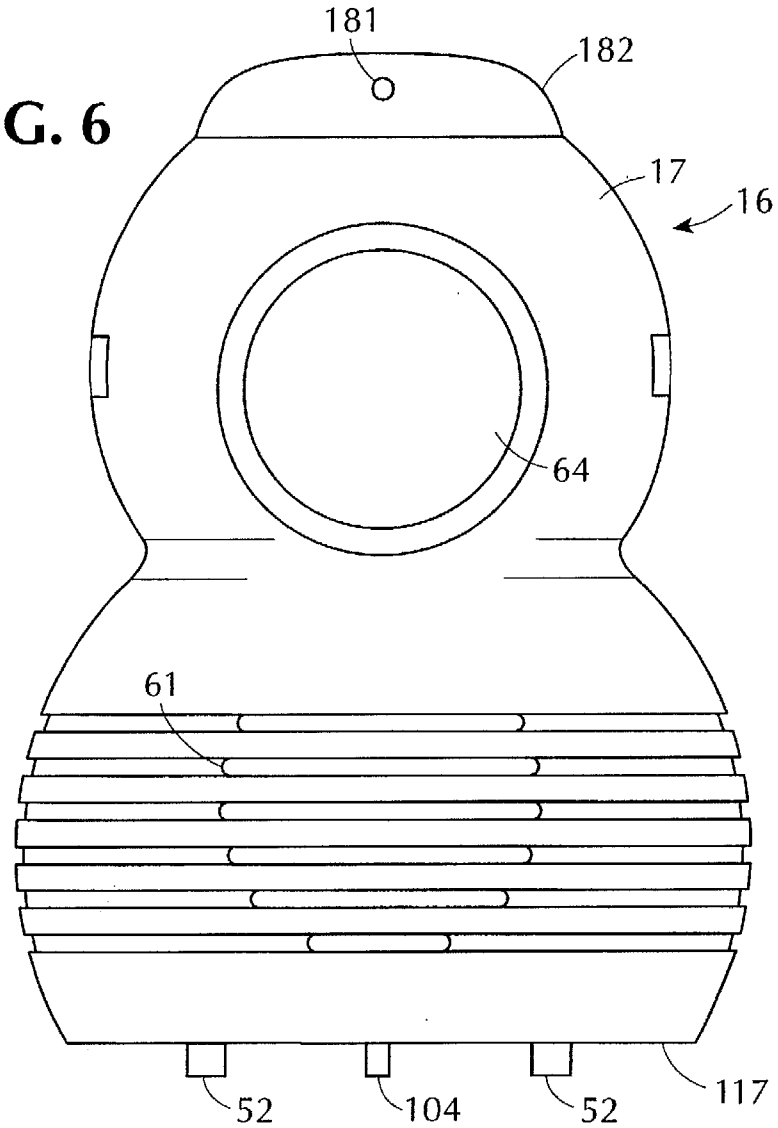
FIG. 6 is a perspective view of a self-propelled target which responds to light from the toy light gun depicted in FIG. 1.
Figure 15:
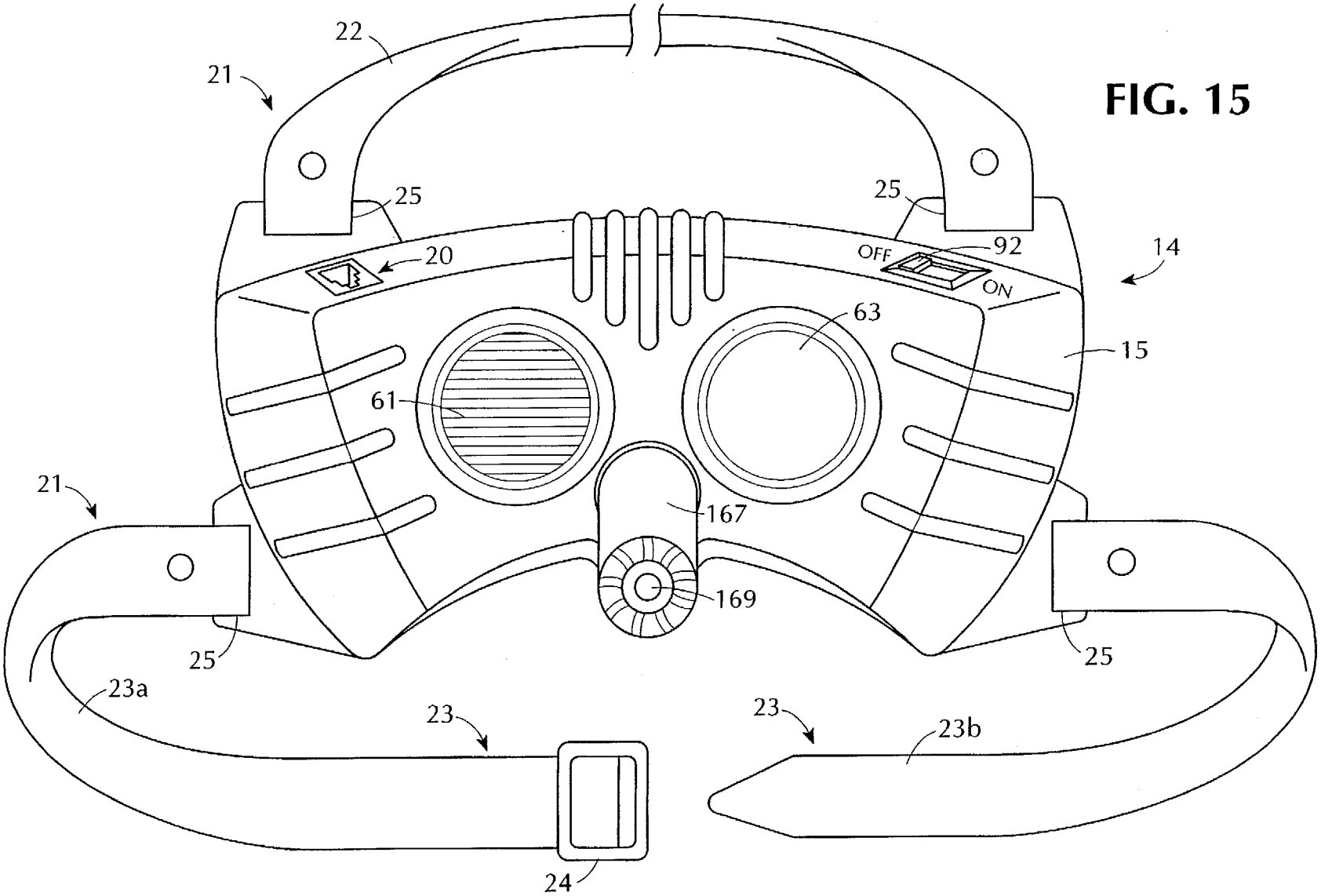
Figure 16:
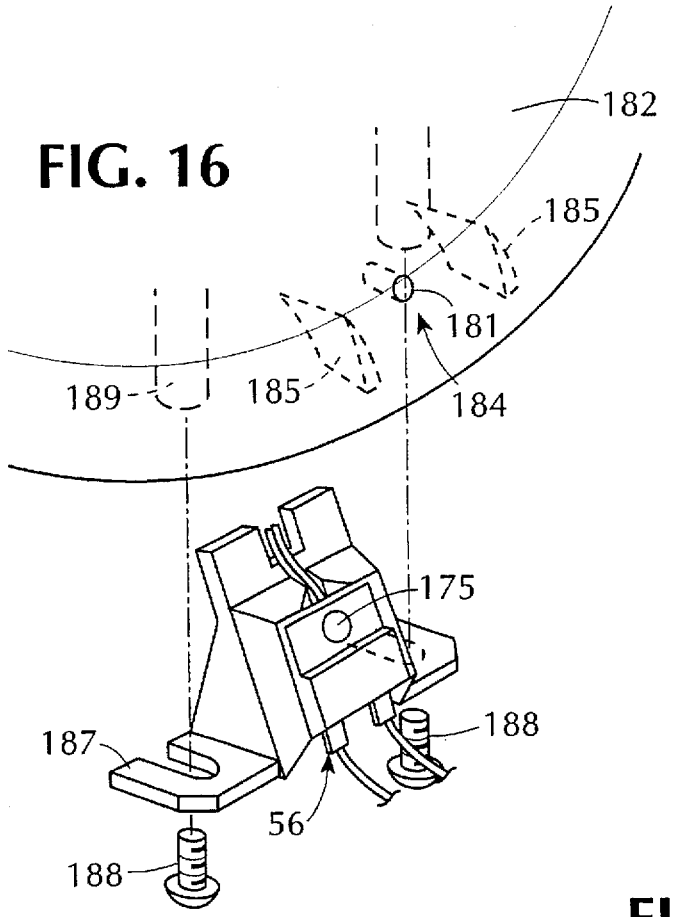
Figure 17:
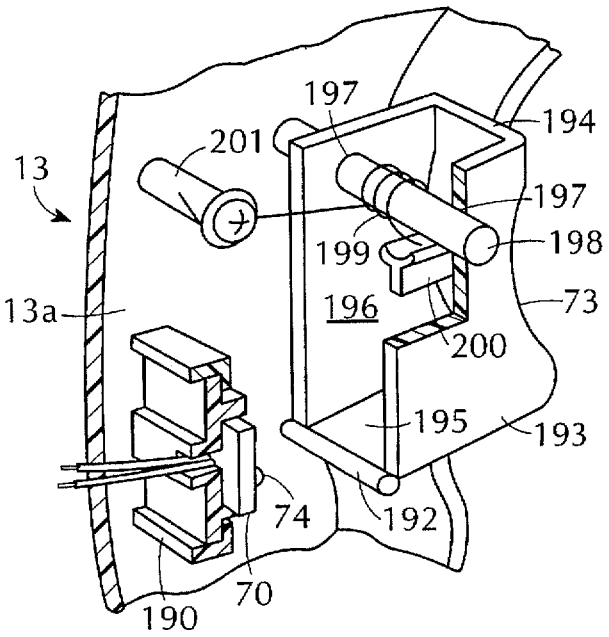
Figure 18:
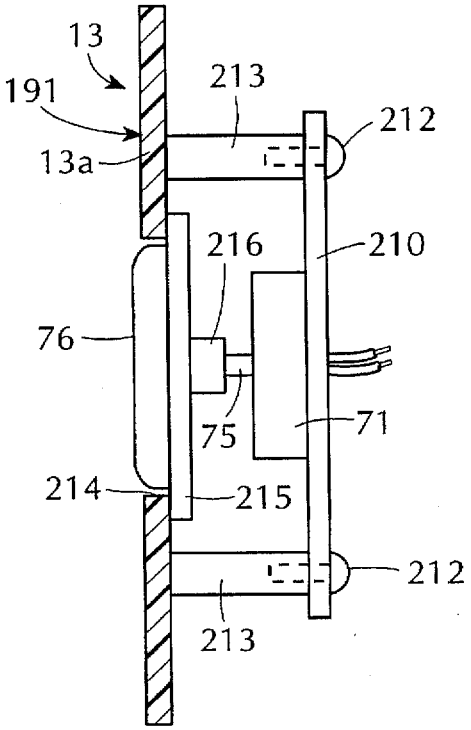

FIG. **14*a*** is an elevation view of an alternate embodiment of the aperture of optical system of the player-worn target;

FIG. 15 is a perspective view of the player-worn target depicted in FIG. 4 but with the optical system thereof for admitting light into the target in a different configuration from that in FIG. 4;

FIG. 16 is an exploded perspective view of the optical section of the self-propelled target depicted in FIG. 6;

FIG. 17 is a perspective view of the trigger mechanism of the toy light gun depicted in FIG. 1 with pan of the trigger shown in section; and FIG. 18 is a section view of one of the switch mechanisms mounted to the side of the toy light gun of FIG. 1.

DESCRIPTION OF THE PREFERRED EMBODIMENTS

Figure 2:
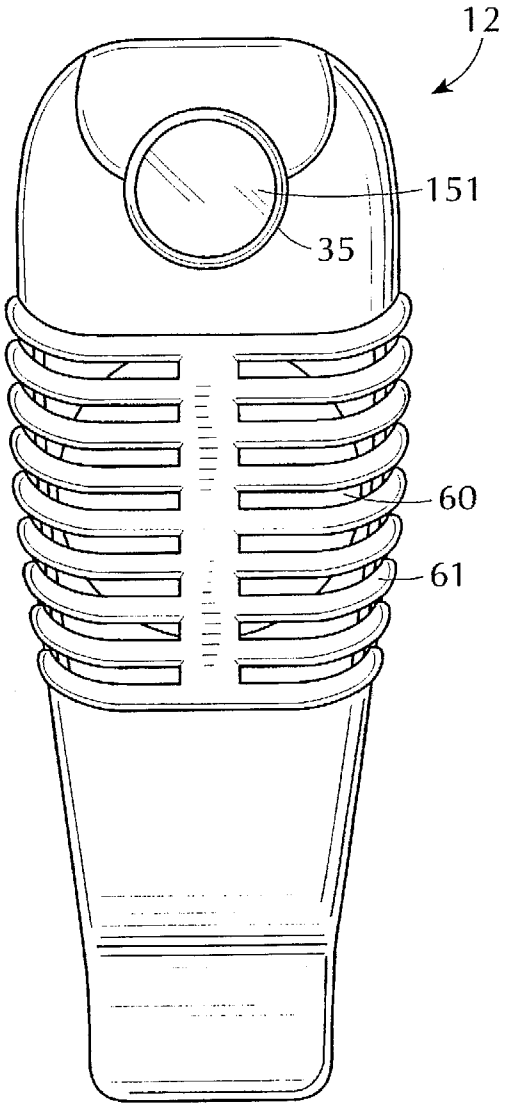
FIG. 2 is a front view of the toy light gun depicted in FIG. 1.
Figure 3:
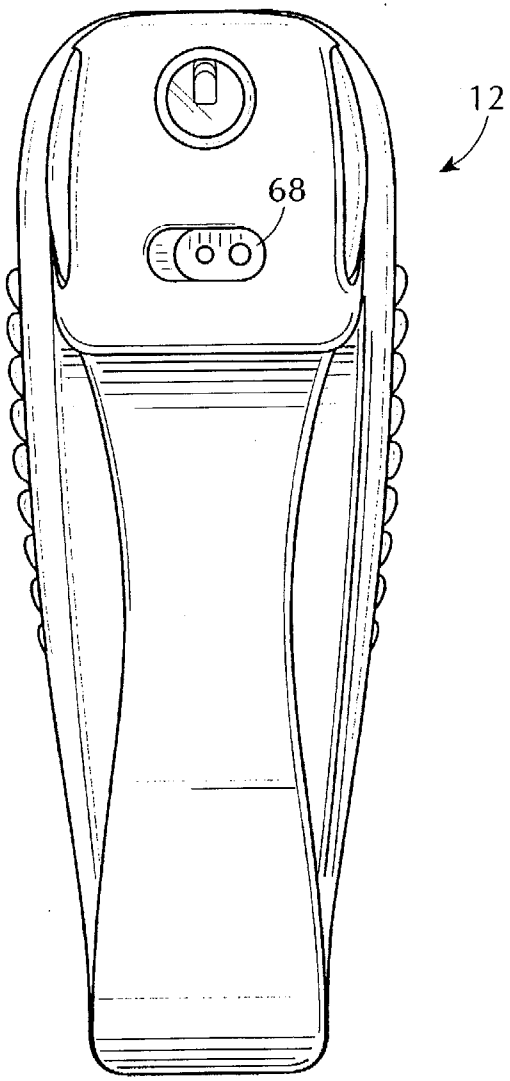
FIG. 3 is a rear view of the toy light gun depicted in FIG. 1.

The inventive shooting game disclosed herein includes a toy light projector or light gun 12 configured as a futuristic "ray" gun (FIGS. 1–3), and either or both a player-worn target 14 (FIG. 4) or a self-propelled target 16 (FIG. 6). The inventive target game may include more than one player-worn target for each player, and in the preferred embodiment two player worn targets are provided, the player-worn target 14 shown in FIG. 4 and another player-worn target 18 shown in FIG. 5. To enhance play value, the targets 14 and 18 are linked by a set of conductors 19 (FIG. 5) and phone jacks 20 (FIGS. 4 and 5) to cooperate and/or share components, for example, for performing functions including: counting hits, reporting hits and/or other events visually and/or audibly, and/or resetting both targets to start a new game, and/or generating or otherwise supplying the power needed to operate the targets, and/or other functions.

Figure 5:
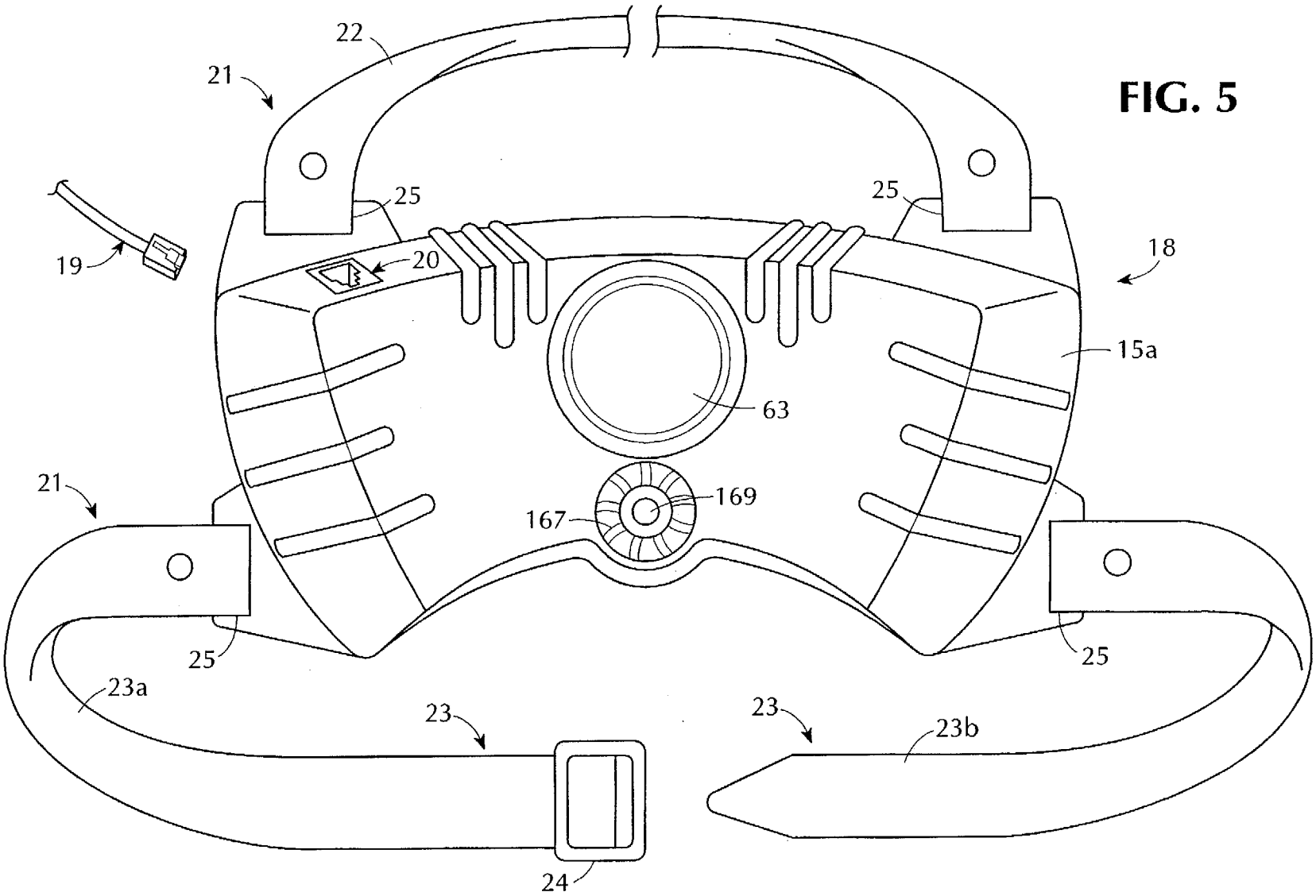
FIG. 5 is a perspective view of another player-worn target which responds to light from the toy light gun depicted in FIG. 1.

The player-worn targets 14 and 18 shown in FIGS. 4 and 5 each have a housing 15, 15*a* and a strap harness 21 by means of which the respective target may be worn on the chest or back of the player. Each harness 21 comprises a one-piece strap 22 attached to the respective vest target and configured to be worn over the shoulders, and a two-piece strap 23*a*, 23*b* with a buckle 24 attached to the respective vest target and configured to be worn around the back. The straps 22, 23*a*, 23*b* are attached to the respective targets through loops 25 on the respective housings 15, 15*a* of the targets. Since both player-worn targets 14 and 18 are worn in a vest-like manner, they are referred to below as "vest" targets.

Figure 7:
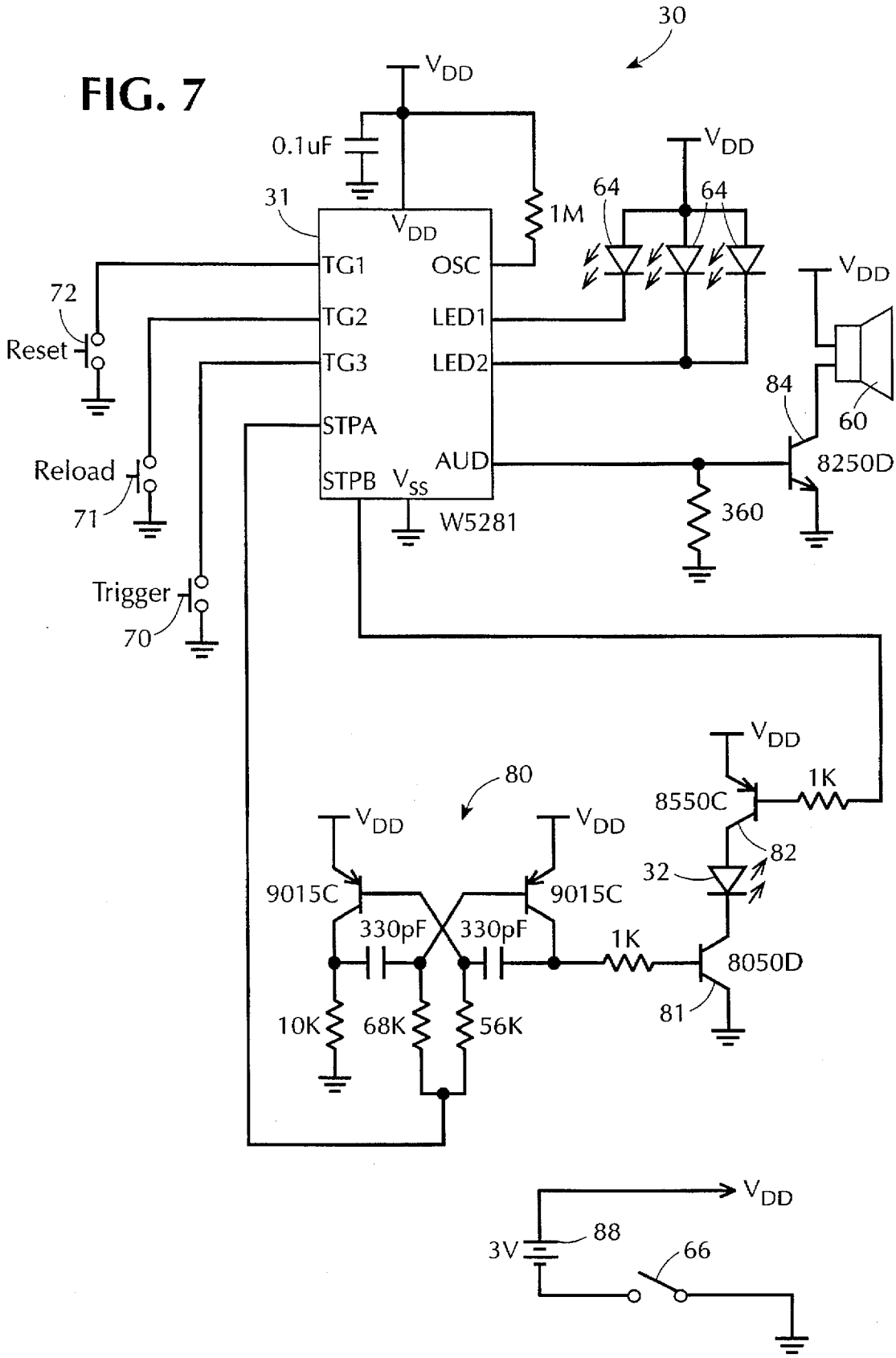
FIG. 7 is a schematic circuit diagram of an electrical circuit carried by the toy light gun depicted in FIG. 1.

The toy light gun 12 includes a housing 13 which carries therein an electrical circuit ("gun circuit") 30 shown in FIG. 7 which includes a controller circuit 31, a light emitter 32 (FIGS. 7 and 13) and an optical system 33 (FIG. 13) which project a beam of light from the toy gun 12 through the light transmitting aperture 35 of the toy light gun (FIGS. 1 and 2) that can be detected by the main and auxiliary vest targets 14 and 18, and by the self-propelled target 16.

Figure 11:
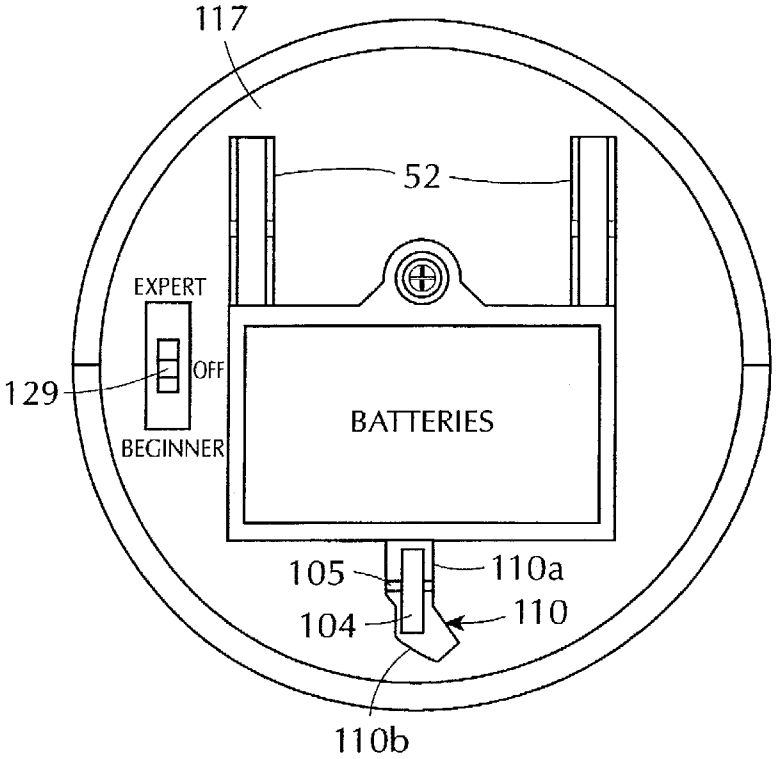
FIG. 11 is a plan view of the bottom of the target depicted in FIG. 5.

As described below, the vest target 14 carries within the housing 15 an electrical circuit ("main vest target circuit) 38 shown in FIG. 8 which includes a controller circuit 40, and the vest target 18 carries within the housing 15*a* an electrical circuit ("auxiliary vest target circuit") 42 shown in FIG. 9 which does not have its own controller circuit but shares the controller circuit 40 (FIG. 7) of the main vest target circuit 38. Therefore, the vest target 14 is referred to as the "main" vest target and the vest target 18 as the "auxiliary" vest target. The self-propelled target 16 has a housing 17 which carries therein an electrical circuit ("self-propelled target circuit 46) shown in FIG. 10 which also has a controller circuit 48. In the preferred embodiment, the self-propelled target 16 includes an electric motor 50 (FIG. 10) and a pair of driven wheels 52 (FIG. 11).

The main vest target 14, the auxiliary vest target 18 and the self-propelled target 16 each include a light receiver 56 (FIGS. 8–10) which detects light projected from the toy gun 12 received by the respective light receiver 56. In the preferred embodiment, the gun light emitter 32 (FIG. 7) is an infrared (IR) light emitting diode (LED) which emits IR light, and the light receivers 56 (FIGS. 8–10) detect IR light. The gun circuit 30 conditions the IR light projected from the toy gun 12, and the main vest target circuit 38, the auxiliary vest target circuit 42 in cooperation with the main vest target circuit 38, and the self-propelled target circuit 46 process IR light received by the respective IR light receiver 56 to determine when light received by a respective IR light receiver 56 is a hit, or a game reset signal, as described below. In the preferred embodiment, the gun circuit 30 amplitude modulates the IR light projected by the gun during short bursts or pulses, and the main vest target circuit 38 and the self-propelled target circuit 46 detect such modulated IR light.

The main vest target 14 and the self-propelled target 16 each have a speaker 60 (FIGS. 8 and 10) which projects sound through a speaker grill 61 in the respective housing 15, 17 (FIGS. 4 and 6), and one or more lamps 62 (FIGS. 8 and 10) controlled by the controller circuit 40 or 48 of the respective electrical circuit 38 and 46 to provide selected audio and/or visual effects associated with a hit, turn-on, game reset, a given number of hits, and game over, as described below. The targets 14, 16 and 18 include light transmitting lenses 63, 64 on the respective housings 15, 15*a*, 17 which transmit light from the respective lamps 62. The toy light gun 12 also has a speaker 60 (FIGS. 2 and 7), a speaker grill 61 (FIGS. 1 and 2) and LEDs 64 (FIGS. 1 and 7) to provide selected audio and/or visual effects associated with firing light pulses and game reset light pulses generated by the toy light gun 12, and toy gun reloading, as described below.

The game is played by a player attempting to "hit" a main or auxiliary vest target 14 or 18, or a self-propelled target 16 with light projected by a light gun 12. Upon detection of light from a toy light gun 12, a main vest target 14, an auxiliary vest target 18 (in cooperation with a main vest target 14) and a self-propelled target 18 will provide audio-visual effects predetermined by the respective circuitry 38 and 46.

The inventive target game provides several features which add to the play value of the game. The toy light gun 12 includes an on-off switch 66 (FIG. 7) activated by a slide button 68 (FIG. 3) on the rear of the toy light gun, and emits a sound for as long as the on-off switch is 66 is on, interrupted by other functions and audio/visual effects. Even if a player turns his or her toy light gun 12 off while approaching another player, when turned on again prior to firing, the toy light gun emits sound to give an opposing player some warning that he or she is about to be shot at. The on-off switch 66 is a two position slide switch which connects and disconnects battery power to the circuit components in the gun circuit 30 as shown in FIG. 7.

The toy light gun 12 includes a trigger switch 70 (FIG. 7), reload switch 71 and a reset switch 72 which control game operation as follows. The toy gun 12 has a spring loaded trigger 73 (FIGS. 1 and 17) and fires a single shot (pulse) of light with each trigger squeeze. The trigger switch 70 is a microswitch having a switch plunger 74 (FIG. 17) positioned within the housing 13 of the toy light gun 12 to be pressed by the pivotally mounted trigger 73. The switch plunger 74 remains depressed as long as the trigger 73 is squeezed, but only a single pulse of light is emitted per trigger squeeze. The gun circuit 30 provides a de-bounce feature such that the circuit 30 responds each time that the trigger switch 70 (FIG. 7) is closed rather than for the length of time that the trigger switch 70 is closed. Because the light emitter 32 in the toy light gun 12 is an LED, which, unlike some prior art "flash" light emitters does not require high energy to "fire", the light emitter 32 will rapidly fire in response to rapid trigger squeezes.

The toy light gun has a reload feature which requires that a player "reload" the light gun actor a given number of shots, i.e., light bursts, for example six. Shot count is controlled by the gun circuit 30 (FIG. 7), and reloading is activated by closing the reload switch 71. The reload switch 71 is a microswitch mounted within the housing 13, having its switch plunger 75 (FIG. 18) positioned adjacent a reload button 76 (FIGS. 1 and 18) provided in the side of the gun housing 13. The spring-loaded switch plunger 75 also spring loads the reload switch button 76 so that upon release of the reload switch button 76, it is pushed back by the spring loaded switch plunger 75.

The toy shooting game has a remote reset feature according to which the hits counted in the main vest target circuit 38 and the self-propelled target circuit 46 are reset remotely to start a new game. The main vest target circuit 38 and the self-propelled target circuit 46 count hits or detections of light from a light gun 12, and in response to a given count of hits, end the game. As mentioned, the hit count may be reset remotely to start a new game, and in the preferred embodiment, the hit count in the main vest target circuit 38 or the self-propelled target circuit 46 are reset remotely by the light gun 12. In the preferred embodiment, closing the reset switch 72 (FIG. 7) causes the gun circuit to emit a pulse of light different from pulses of light emitted in response to trigger switch 70 closings. The reset switch 72 is a microswitch identical to the reload microswitch 71 (FIG. 18), mounted within the housing 13 and activated by a reload button (not shown) identical to the reload button 76 mounted on the side of the gun housing 13 opposite to that on which the reload button 76 is mounted.

As mentioned, the optical system of a target (vest targets 14 and 18 in the preferred embodiment) is adjustable (FIGS. 14 and 14A), and the motion of the self-propelled target may be programmed (psuedorandomly in the preferred embodiment). As described above, the auxiliary vest target 18 shares components and interacts with the main vest target 14.

The game is operable under varying light conditions, from darkness, to dim lighting to bright daylight, and for distances exceeding 50 feet. In varying light conditions, performance (e.g., maximum detection distance or hit registration) varies by only about 10%.

How these features and performance are accomplished and how other aspects and features of the game are accomplished are described in more detail below.

Toy Light Gun 12

Referring to FIG. 7, the controller circuit 31 of the gun circuit 30 may be any suitable circuit which can perform the following functions through hardwiring and/or software: cause IR LED light emitter 32 to emit light with different characteristics in response to a trigger switch 70 closing and a reset switch 72 closing; count trigger switch 70 closings and require a reload switch 71 closing to cause the light emitter 32 to emit light after a given number, e.g., six, of consecutive trigger switch 70 closings without a reload switch 71 closing, illuminating LEDs 64 and/or producing sounds on speaker 60 in response to given closings of switches 70–72.

In the preferred embodiment, the controller circuit 31 is a W5281 voice synthesizer integrated circuit available from Windbond Electronics Corp. (Republic of China). In addition to programmable processor and control circuitry, the W5281 includes an ADPCM (adaptive differential pulse-code modulation) voice synthesizer. The controller circuit 31 is programmed and connected to operate as described below.

Referring to FIG. 7, the light emitter 32 in the light gun 12 is, as mentioned, an IR LED which is selectively energized by the controller circuit 31 in response to closings of the trigger switch 70 and the reset switch 72. The toy gun 12 emits bursts of IR light from the IR LED 32 through the optical system 33 (FIG. 13) and the aperture 35 (FIGS. 1 and 2) in the front of the light gun. In order for the intended vest or self-propelled target 14, 16 or 18 to determine whether a particular light burst is a shot or a reset, the light output by the IR LED 32 is coded. Any suitable coding, digital and/or analog, may be used, and the vest and self-propelled targets 14 and 16 include suitable decoding circuitry. In the preferred embodiment, the gun controller circuit 31 and associated circuitry described below encode the light bursts by amplitude modulating them (e.g., by chopping) at a preselected frequency, and by providing different length bursts or pulses for IR light projected in response to trigger switch 70 and reset switch 72 closings.

The controller circuit 31 of the gun control circuit 30 (FIG. 7) controls the current supplied to IR LED 32 thorough its STPA and STPB ports, bi-stable multivibrator circuit 80 and transistors 81 and 82 to amplitude modulate the current at the preselected frequency, which in the preferred embodiment is 37.9 KHz. The STPA port is controlled to cause the multivibrator circuit 80 to switch transistor 81 on and off at a 37.9 KHz. rate. The STPB port is controlled to turn transistor 82 on for the preselected pulse widths responsive to a trigger switch 70 closing or a reset switch 72 closing. In response to trigger switch 70 closings and reset switch 72 closings, the controller circuit 31 provides cycles of STPA and STPB port states which cause the IR LED 32 to emit IR light modulated (e.g., chopped) at a 37.9 KHz. rate for a first period of time and for a second period time period, respectively, for example 1.0 ms. and 1.5 ms. However, pulse widths of longer or shorter duration may be used, and other modulation techniques may be used, as will be known to those of skill in the art.

The controller circuit 31 is set by to provide a given number of STPA and STPB cycles in response to trigger switch 70 closings. For example, after six trigger switch 70 closings, the controller circuit 31 does not initiate any further STPA and STPB cycles which would cause IR LED 32 to emit light in response to further trigger switch 70 closings until a reload switch 71 closing. In response to a reload switch 71 closing, the controller circuit 31 resets a count of the closings of the trigger switch 70 and again responds to trigger switch 70 closings to initiate further cycles of the STPA and STPB states. The counting function may be implemented in software and/or hardware in the controller circuit 31.

The controller circuit 31 of the gun control circuit 30 (FIG. 7) also controls illumination of the LEDs 64. In the preferred embodiment where the controller circuit comprises a W5281 IC, two LED outputs LED1 and LED2 are provided to control illumination of three LEDs 64. Two of the three LEDs 64 are connected in parallel and are illuminated at the same time. However, as shown in FIG. 1, the three LEDs 64 are arranged in a row with the two parallel-connected LEDs being the first and last ones in the row spaced by the third LED, so as to diminish any perception that the two parallel-connected LEDs are being illuminated at the same time.

The controller circuit 31 includes a synthesizer which generates audio signals for different sounds in response to closings of switches 66 and 70–72. In the preferred embodiment where the controller circuit 31 comprises a W5281 IC, the audio signals are output on the AUD output to the base of the speaker drive transistor 84, and the speaker 60 is connected in the collector-emitter circuit of speaker drive transistor 84.

Summarizing, the controller circuit 31 is programmed to provide the following audio/visual responses to closings of the on-off switch 66, the trigger switch 70, the reload switch 71 and the reset switch 72. Closing the on-off switch 66 supplies power from a battery 88 to the controller circuit 31, the LEDs 64, the speaker 60 (speaker drive transistor 84), multivibrator circuit 80 and transistor 82. As long as battery power is applied to the controller circuit 31, it outputs an audio signal to the speaker drive transistor 84 to cause the speaker 60 to sound a beeping sound, which continues except for momentary interruptions for the speaker to perform other functions and sound other sounds in response to the closings of switches 70–72, after which the beeping sound is resumed. In response to a closing of the reload switch 71, the controller circuit 31 (a) resets the count of trigger switch 70 closings and enables the controller circuit 31 to respond to the preprogrammed number of trigger switch 70 closings, and (b) causes an audio signal to be supplied to speaker drive transistor 84 to cause the speaker 60 to sound a gun reloading sound.

In response to a closing of trigger switch 70 (FIG. 7), the controller circuit 31 (a) causes its STPA and STPB outputs to go to logic low levels to sink current in a sequence to supply current at 37.9 Khz. through IR LED 32 for the first time period, and at the same time (b) to supply audio signals to speaker drive transistor 84 to cause speaker 60 to sound a futuristic laser shot sound and (c) alternatingly cause its LED1 and LED2 outputs to go low and sink current to alternatingly flash the LEDs 64 for a short time period, e.g., one to two seconds, as discussed above. After the preprogrammed number of trigger switch 70 closings has been reached, the controller circuit will not respond to further trigger switch 70 closings until it senses a closing of the reload switch 71. During the first time period, the IR LED 32 emits a burst or pulse of IR light modulated at 37.9 KHz. of width equal to the first time period.

In response to a closing of the reset switch 72 (FIG. 7), the controller circuit 31 (a) causes its STPA and STPB outputs to go to logic low levels to sink current in a sequence to supply current at 37.9 KHz. through IR LED 32 for the second time period, and (b) to supply audio signals to speaker drive transistor 84 to cause speaker 60 to sound a reset firing sound somewhat similar to but easily distinguishable from a light burst firing sound. During the second time period, the IR LED 32 emits a burst or pulse of IR light modulated at 37.9 KHz. of width equal to the second time period.

As discussed below, the main vest target circuit 38 (FIG. 8) in the vest target 14 and the self-propelled target circuit 46 (FIG. 10) in the self-propelled target 16 detect the bursts of 37.9 KHz. modulated IR light and can distinguish between the first and second time periods to thereby determine whether the detected IR light corresponded to a trigger switch 70 closing or a reset switch 72 closing.

The invention provides a simple and inexpensive scheme for eliminating response to stray and spurious IR light and for coding the IR light for shots and reset. Simply modulating the IR light at a preselected frequency for pulses of different widths, as described above, accomplishes this.

Main Vest Target 16

Figure 8:
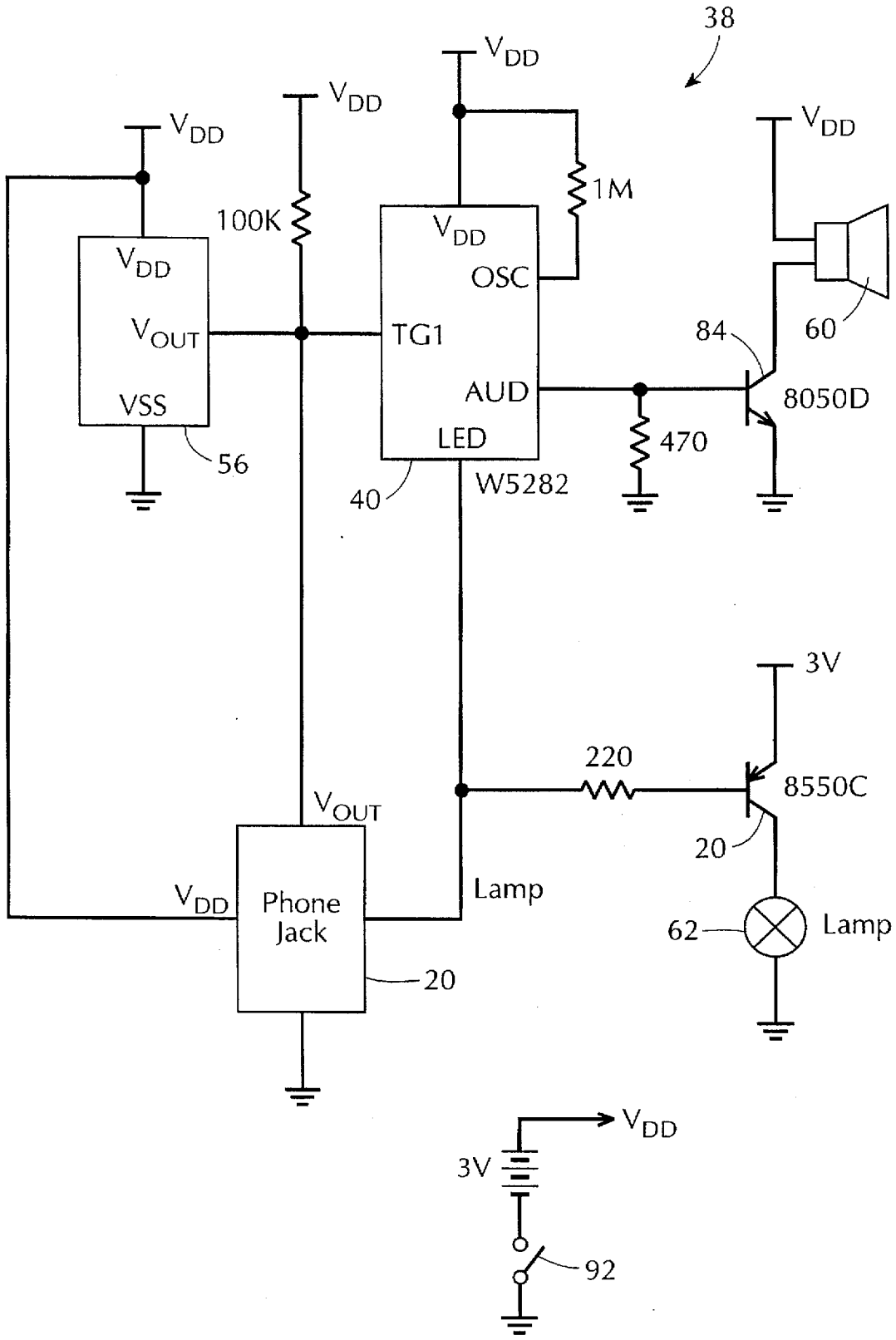
FIG. 8 is a schematic circuit diagram of an electrical circuit carried by the player-worn target depicted in FIG. 4.
Figure 9:
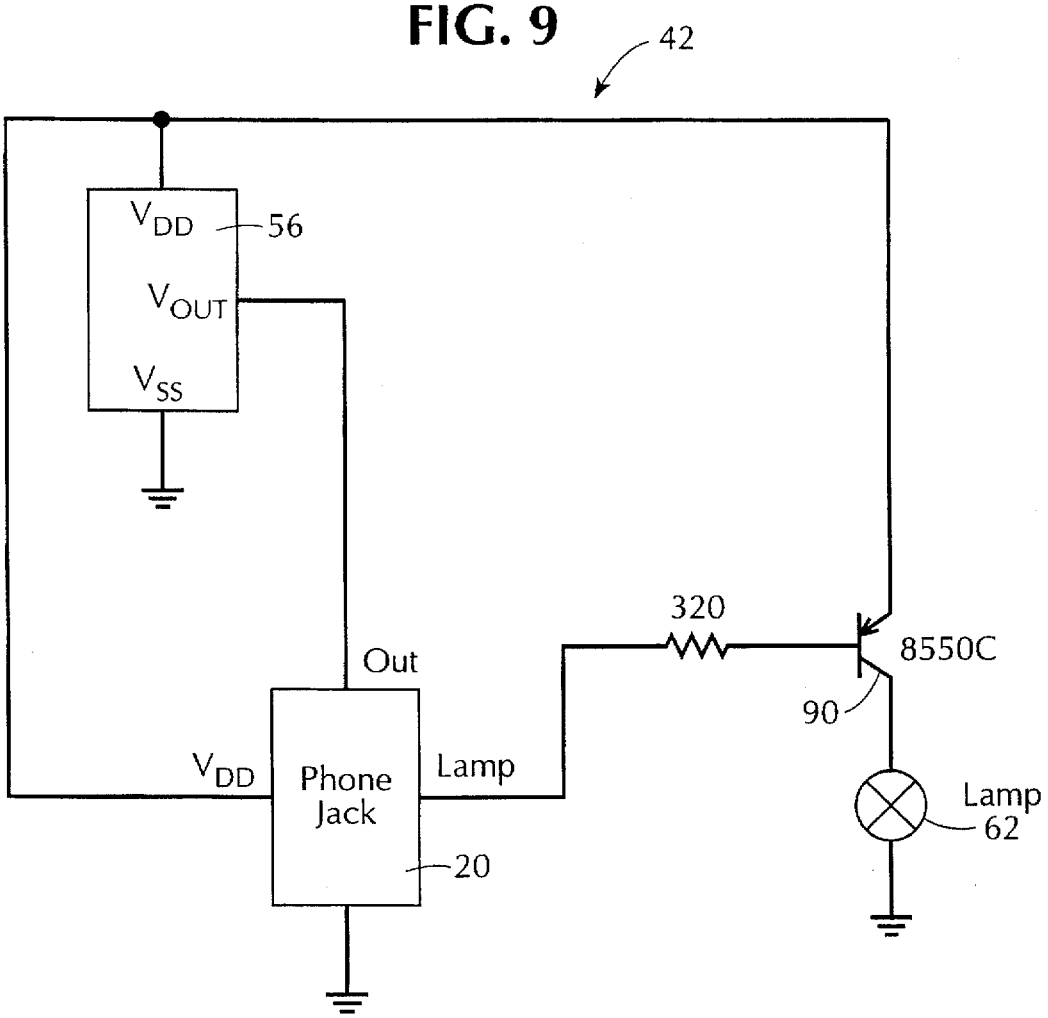
FIG. 9 is a schematic circuit diagram of an electrical circuit carried by the player-worn target depicted in FIG. 5.

Referring to FIG. 8, the main vest target circuit 38 includes the IR receiver 56, the controller circuit 40, the speaker 60, a speaker drive transistor 84, a miniature lamp 62, a lamp drive transistor 90 for a miniature lamp 62, an on-off switch 92 (FIGS. 4 and 8) and a phone jack 20 (FIGS. 4 and 8). The IR light receiver 56 provides an output related to the IR light it detects, for example the IR light receiver 56 provides a given logic level on its $V_{out}$ output when it detects IR light with given characteristics. In the preferred embodiment, the IR light receiver 56 is a 12043 Series infrared receiver available from Kodenshi Corp. (Tokyo. Japan). The 12043 Series infrared receiver detects infrared light modulated at a given $f_0$ frequency of 37.9 KHz., and in response provides a low logic level on the $V_{out}$ output.

The controller circuit 40 (FIG. 8) is coupled to the $V_{out}$ output of the IR light receiver 56, and determines whether the IR light detected by the IR light receiver 56 has given characteristics. For detected IR light that has the given characteristics, the controller circuit 40 provides audio signals to speaker drive transistor 84 and LED drive signals on its LED output to flash the lamp 62, for a short period of time, e.g., one to two seconds. In the preferred embodiment, the controller circuit 40 is a model W5282 integrated circuit available from Windbond Electronics Corp.

In the preferred embodiment, the IR light receiver 36 (FIG. 8) provides a low output on its $V_{out}$ output as long as it detects IR light modulated at 37.9 KHz. The controller circuit 40 at its TG1 port receives the output from the IR light receiver 56 and determines the length of the IR light pulse or burst detected by the IR light receiver 56. For light bursts of the first and second pulse widths, indicative of a trigger switch 70 closing and a reset switch 72 closing in the light gun 12, the controller circuit 40 provides different outputs to the speaker drive transistor 84, and only provides drive to the lamp drive transistor 90 in response to detected light burst of the first pulse width (trigger switch closings). Also. detected first pulse widths are counted by the controller circuit 40 as hits, and after a first and second number of hits, the controller circuit 40 provides different outputs to the speaker drive transistor 84 and terminates the game after counting the second number of hits. The on-off switch 92 supplies battery power $V_{DD}$ from a battery 94 to the circuit components as shown in FIG. 8.

The controller circuit 40 (FIG. 8) is programmed to provide the following audio/visual responses to closings of the on-off switch 92 and detection of the first and second pulse widths output by the IR light receiver 56. Closing the on-off switch 92 causes the controller circuit 40 to reset the count of hits therein and to provide audio signals to speaker drive transistor 84 to sound a reset e.g., a single, long siren sound, and to provide a sequence of low logic levels on its LED output to flash the lamp 62. In response to a low logic level of the first pulse width on the $V_{out}$ output of the IR light receiver 56, the controller circuit 40 counts a hit and provides audio signals to the speaker drive transistor 84 to cause the speaker 60 to sound a hit sound, e.g., crash sound, and to provide a sequence of low logic levels on the LED output to flash the lamp 62. The counting function may be implemented in the controller circuit 40 by software and/or hardware.

Upon counting the first given number of hits, the controller circuit 40 also supplies audio signals to the speaker drive transistor 84 to cause the speaker 60 to sound a game almost over sound e.g., short, repeating siren sounds. Upon counting the second given number of hits, the controller circuit 40 also supplies audio signals to the speaker drive transistor 84 to cause the speaker 60 to sound a game over sound, e.g., a bomb sound. The first given number may be five hits and the second given number to end a game may be six hits. After counting the second given number of hits, the controller circuit 40 does not respond to further hits until either the on-off switch 92 is opened and closed, or IR light of a second pulse width is received by the IR light receiver 56. Upon detecting a low at the TG1 input for the second pulse width, the controller circuit 40 provides the outputs described above for a closing of the on-off switch 92 to reset the hit counter and restart the game.

The main vest target 14 and the auxiliary vest target 18 each have a phone jack 20 (FIGS. 4 and 5) for electrically connecting an auxiliary target 18 to a main vest target 14. The phone jack 20 (FIG. 8) in the main vest target 14 has connected thereto the LED output and the TG1 input of the controller circuit 40 and the $V_{DD}$ battery voltage. An auxiliary target 18 by virtue of the connections of the phone jack 20 to the controller circuit 40 and the battery 94, shares the controller circuit 40, the speaker 60, the battery 94 and the on-off switch 92 of the main vest target 14 to which it is connected, as described below.

The controller circuit 40 may output audio signals for speech in addition to or in place of the sounds described above, and many combinations of sound, speech and light for both content and sequence may be programmed. Also, more than one lamp 62 may be driven by transistor 90, and more than one lamp circuit may be provided.

Auxiliary Vest Target 18

The auxiliary vest target circuit 42 (FIG. 9) includes an IR light receiver 56, a lamp driver transistor 90, a lamp 62 and a phone jack 20. The IR light receiver 56 is identical to that in the main vest target circuit 38, and has its output $V_{out}$ connected to the phone jack 20. The controller circuit 40 (FIG. 8) in the main vest target circuit 38 receives the output of the IR light receiver 56 in the auxiliary vest target circuit 42 and responds to the pulses output by the IR light receiver as described above. Thus, the controller circuit 40 in the main vest target circuit 38 counts hit IR pulses and responds to reset IR pulses from the IR light receivers 56 of both the main vest target circuit 38 and the auxiliary vest target circuit 42. The controller circuit 40 of the main vest target circuit 38 supplies audio signals to the speaker drive transistor 84 in the main vest target circuit 38, and supplies LED output signals to the lamp drive transistors 90 in the main vest target circuit 38 and in the auxiliary vest target circuit 42 via the phone jacks 98 and wires in set 19 (FIG. 5) connecting the phone jacks, in response to hit and reset pulses from the IR receivers 56 of both the main and auxiliary vest targets. The on-off switch 92 in the main vest target circuit 38 controls the battery power supplied to the auxiliary vest target circuit 42 via phone jacks 20 and wires in set 19.

Self-propelled Target

The self-propelled target circuit 46 (FIG. 10) includes a controller circuit 48, an IR light receiver 56, a speaker drive transistor 84, a speaker 60 and three lamp drive transistors 90 which drive three lamp 62 of different color. These components operate as described above for the controller circuit 40 of the main vest target circuit 38 with respect to audio/visual and game termination and reset functions, except that three lamps 62 are illuminated from three outputs (STPA, STPB and STPC) of the controller circuit 48. In the preferred embodiment, the controller circuit 48 of the self-propelled target circuit 46 is a W5282 integrated circuit available from Windbond Electronics Corp. The controller circuit 48 is programmed differently from the controller circuit 40 of the main vest target circuit 38 in order to illuminate three lamps 62 instead of one, and also to provide for driving the motor 50 in the self-propelled target 16.

Figure 12:
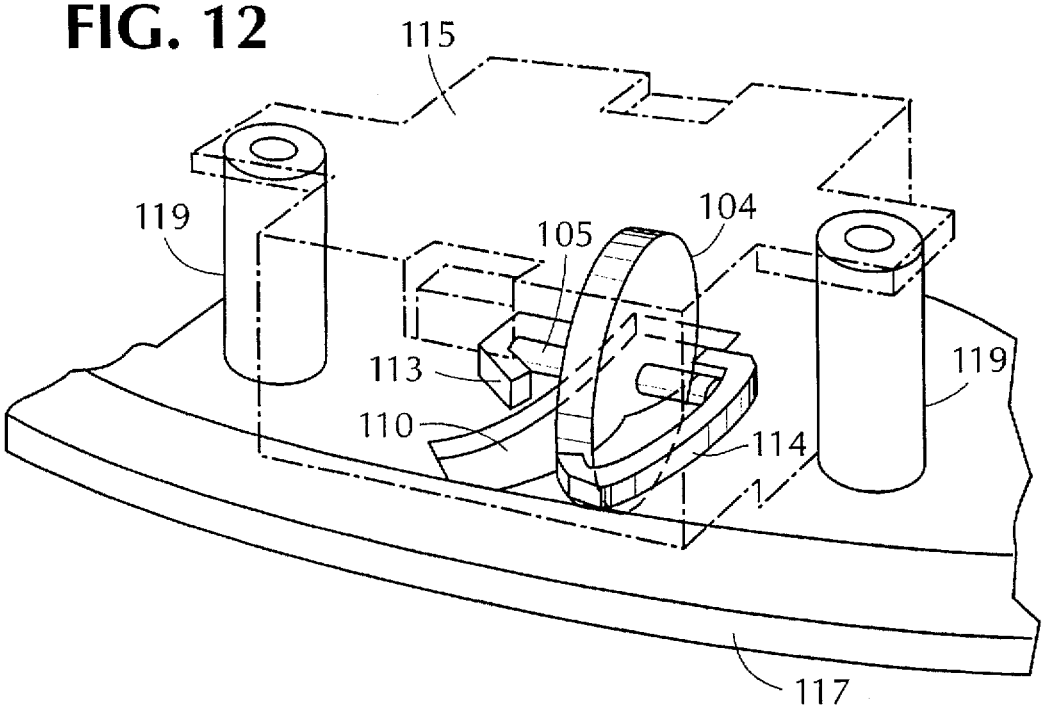
FIG. 12 is a perspective view of a portion of the bottom of the self-propelled target depicted in FIG. 6 with the housing removed, showing one of the wheels on which the self-propelled target rides and the supporting structure therefor.
Figure 12A:
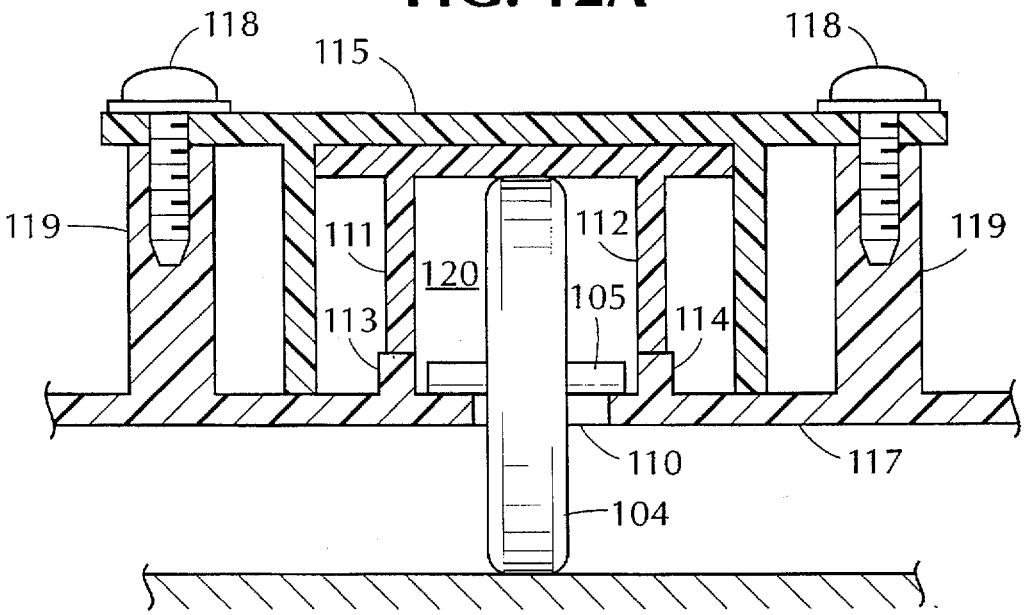
FIG. 12A is a section view through the bottom of the self-propelled target depicted in FIG. 6 showing the portion depicted in FIG. 12.

The driven wheels 52 (FIG. 11) are mounted on a common shaft or axle (not shown) driven by the shaft (not shown) of the motor 50 (FIG. 10) and gearing (not shown). The wheels 52 are driven by the motor 50 in both clockwise (forward) and counterclockwise (reverse) directions with reference to FIG. 11. A third, undriven wheel 104 (FIGS. 11, 12 and 12A) is mounted for free rotation forward of the driven wheels 52. The axle 105 of the wheel 104 is suspended as shown in FIGS. 12 and 12A for pivotal movement within a slot 110 in the bottom 117 of the target housing 17. The axle 105 is retained in a track 120 defined by upper wall sections 111 and 112 (FIG. 12) and lower wall sections 113 and 114 within the target 16). Wall sections 111 and 113 are alighted and have generally the same configuration, and wall sections 112 and 114 are aligned and have generally the same configuration. The upper wall sections 111 and 112 depend from a housing 115 connected to the bottom 117 of the target 16 by screws 118 received in posts 119 connected to the bottom 117. The lower wall sections are integral with the bottom 117 and project upwardly, meeting the upper wall sections 111 and 112 to define a non-linear retaining space or track 120 for the opposite ends of the axle 105. The slot 110 (FIG. 11) has a section **110*a* perpendicular to the axle of wheels 52 and a section 110*b* forwardly thereof at a non-parallel angle thereto, which as shown is an acute angle. The track 120 (FIG. 10) prevents one end of the axle 105 from translating while allowing the other end to swing, thereby providing a pivotal movement of the non-driven wheel 104 in the slot 110 which acts to change the direction of movement of the self-propelled target 16 as driven by wheels 52** in both forward and reverse directions of movement of the self-propelled target.

Figure 10A:
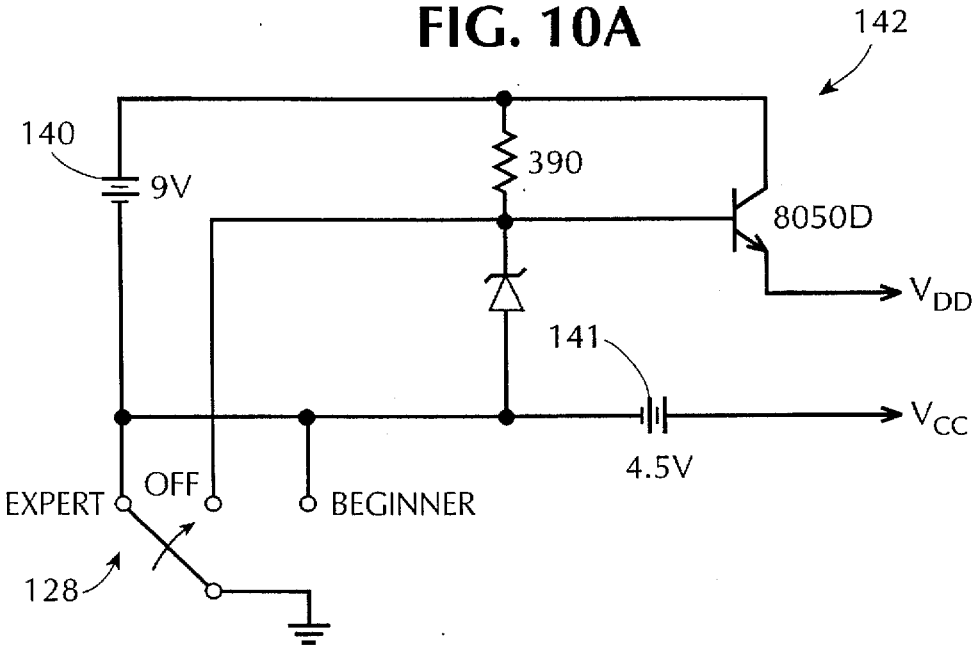
FIG. 10A is a schematic circuit diagram of the switch and power supply circuit for the circuit of FIG. 10.
Figure 10:
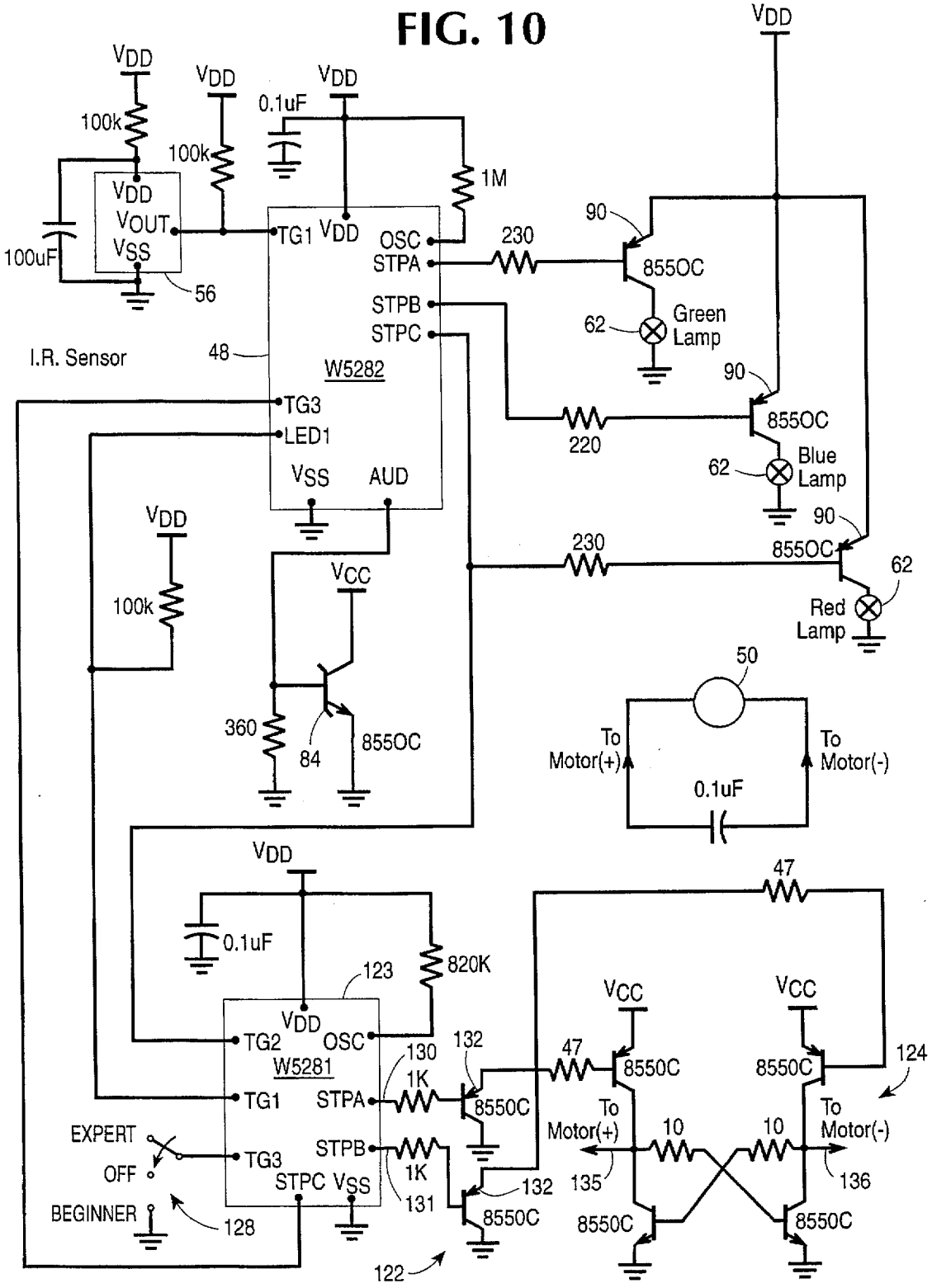
FIG. 10 is a schematic circuit diagram of an electrical circuit carried by the self-propelled target depicted in FIG. 6.

Referring to FIG. 10, the direction of rotation of the motor 50 and the sequence of changes in direction thereof are controlled by a motor control circuit 122 which includes a controller circuit 123 and a drive circuit 124. The controller circuit 123 is programmed by software and/or hardwiring to provide the motor direction sequence and the duration of the sequence. In the preferred embodiment, the controller circuit 123 is a model W5281 integrated circuit available from Windbond Electronics Corp. The controller circuit 123 is programmed to provide a pseudorandom sequence of outputs on outputs STPA and STPB. The controller circuit may be further programmed to make the sequence responsive to the inputs on ports TG1 and TG2. The TG1 port of controller circuit 123 is connected to the LED1 output of controller circuit 48; the TG2 port of the controller circuit 123 is connected to the STPC port of the controller circuit 48. The TG3 port of controller circuit 122 is connected to a two pole, three position switch 128 (part of which is shown in FIG. 10A), and the input on TG3 determines the length of the sequence, e.g., 35 or 58 seconds (designated EXPERT and BEGINNER, respectively, in FIG. 11 alongside the switch lever 129 of the switch 128). Switch 128 also functions as an on-off switch. Referring to FIGS. 10 and 10A, in one position of the switch 128, it connects the TG3 port of the controller circuit 122 to ground; in a second position it floats the TG3 input; and in the third position it floats the TG3 input and also opens the circuits of batteries 140 and 141 by disconnecting them from ground. Switching the switch 128 to the first or second position (FIG. 10A) closes the battery circuits and at the same time selects a sequence length.

The drive circuit 124 (FIG. 10) is a bistable multivibrator circuit having inputs 130, 131 connected to the STPA and STPB ports of the controller circuit 123 through respective transistors 132, and complementary outputs 135, 136 connected to the motor 50. Low levels on the STPA and STPB ports of the controller circuit 123 set and reset the multivibrator circuit 124 and toggle the outputs 135 and 136 at varied intervals of 0.5 sec., 1.0 sec. and 1.5 sec. to cause the motor 50 to reverse direction. Other time intervals for changing direction may be used, and other techniques for changing motor direction may be used, as will be known to those of skill in the art.

The self-propelled target circuit 46 (FIG. 10) has two batteries (FIG. 10A), battery 140 and battery 141, and a voltage regulator 142 coupled to battery 140. Battery 141 provides voltage $V_{CC}$ connected to the drive circuit 120 via switch 128 and battery 140 provides voltage to the voltage regulator 142 which provides the voltage $V_{DD}$ to all other circuit components in FIG. 10 of the self-propelled target circuit 46.

For counting hits, and responding thereto and to reset pulses, the self-propelled target circuit 46 (FIG. 10) operates as described for the main vest target circuit 38, except that three lamps 62 of different color are illuminated in a given sequence. The self-propelled target 16 has a clear lens 64 (FIG. 6) to allow transmission therethrough of the different colors. The lamps 62 are positioned centrally in the housing 17 of the self-propelled target 16 aligned with the lens 64 and another identical lens (not shown) in the housing 17 opposite lens 64, so that light is projected from opposite side of the target 16 when the lamps 62 are energized. Whenever the switch 128 is in the first or second position (the switch lever 129 shown in FIG. 11 moved to the beginner or expert position), the self-propelled target 16 is self-propelled and moves in a path determined by the sequence of motor reversals controlled by self-propelled target circuit 46: and the configuration of the surface it rides on and obstacles that the self-propelled target encounters to which the third wheel 104 (FIG. 11 ) reacts. The self-propelled target 16 terminates a game as described for the main vest target 14 (i.e., after a given number of hits, e.g., four), or after the expiration of the selected motor reversal sequence length.

The self-propelled target 16 adds three levels of play value to the game. With a self-propelled target 16, the game may be played by one player. With the pseudorandom motor reversal sequence of the self-propelled target 16 and surface terrain and obstacles, the motion of the self-propelled target is essentially unpredictable during a game. And the self-propelled target 16 provides a time element to the game in addition to the hit count element provided by the vest targets.

Optics

Figure 13:
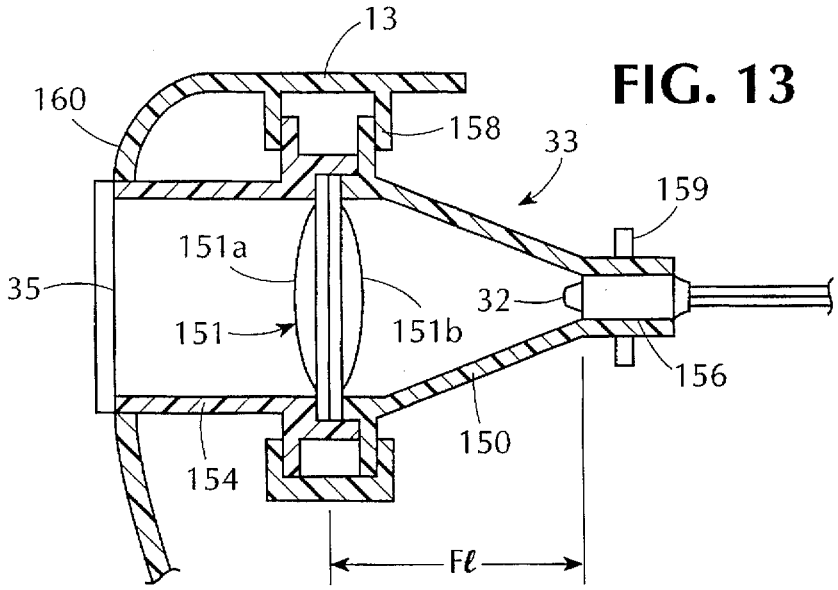
FIG. 13 is a schematic diagram of the optical system of the toy light gun depicted in FIG. 1.

Referring to FIG. 13, the optical system 33 of the toy light gun 12 includes a conical section 150, a lens 151 comprised of a pair of convex lenses 151*a* and 151*b* placed flat side to flat side, a tubular section 154 and the aperture 35. The IR LED 32 is positioned in a tubular opening 156 at the apex of the conical section 150, and the lens 151 is positioned at the maximum diameter end of the conical section 150 where the conical section 150 meets the tubular section 154. The focal length "fl" of the lens 151 in the preferred embodiment is 19.0 mm. The interior surfaces of the conical section 150 and the tubular section 154 are coated with a black, non-reflective paint. The optical system 33 projects IR light from the IR LED 42 through the aperture 35 and out of the toy light gun 12 in a narrow beam. The optical system 33 is held in the gun housing 13 (partially shown in FIG. 13) by annular flanges 157, 158, 159 and 160 attached to the gun housing 13.

Figure 14:
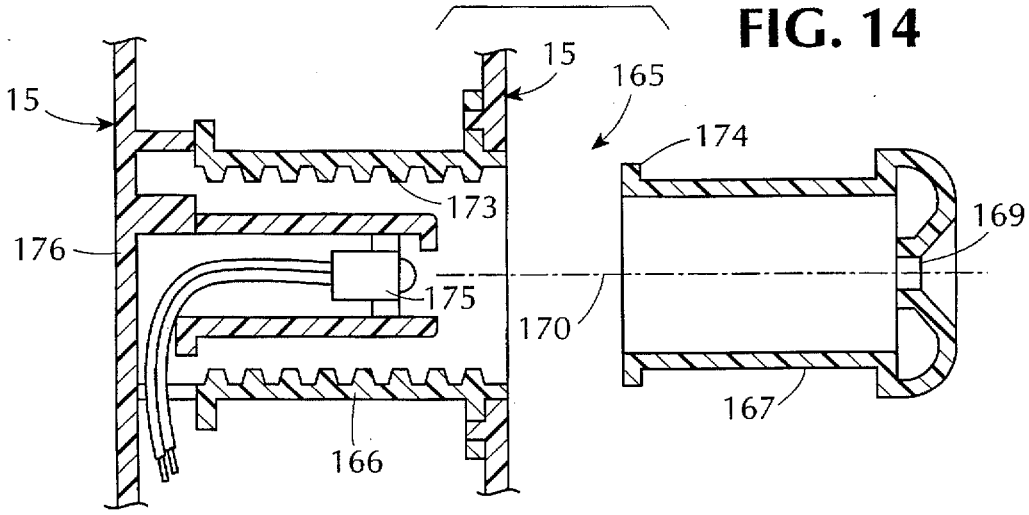
FIG. 14 is a partially exploded section view of the optical system of the player-worn target depicted in FIG. 4.

Referring to FIG. 14, the optical system 165 in the main and auxiliary target vests 14 and 18 comprises telescoping tubular sections 166 and 167. Tubular section 167 has an aperture 169 through which IR light from a toy light gun 12 is admitted into the optical system 165. The aperture 169 is aligned with the optical axis 170 of the optical system 165. The tubular section 166 is internally threaded (173) and the tubular section 167 has an annular tab 174 which functions as an external thread so that the tubular section 167 may be advanced out of and retracted into the tubular section 166 with a simple manually-applied rotating action, to change the length of the optical path from the aperture 169 to the IR detector element 175. The IR detector element 175 of the IR light receiver 56 is connected to the rear 176 of the vest targets housings 15, 15*a*, aligned with the optical axis 170, positioned in the end of the tubular section 166 opposite to the end into which the tubular section 167 projects. The interior surfaces of the tubular sections 166 and 167 are coated with a black, non-reflective paint.

Retracting the tubular section 167 into the tubular section 166 positions the IR detector element 175 closer to the aperture 169 (shortens the optical path), which enlarges the angle at which entering beams of IR light may impinge upon the IR detector element 175. This makes it easier for a player to hit the detector element with a beam of light from a toy light gun 12. FIG. 4 shows the tubular section 167 fully retracted. Conversely, advancing the tubular section 167 out of the tubular section 166 positions the IR detector element 175 farther from the aperture 169 (lengthening the optical path), which reduces the angle at which entering beams of IR light may impinge upon the IR detector element 175. This makes it harder for a player to hit the detector element with a beam of light from a toy light gun 12. FIG. 15 shows the tubular section 167 fully advanced. Other arrangements may be used to change the length of the optical path and to enhance and/or retract IR light entering the optical system 165 for the main vest target 14.

Figure 14A:
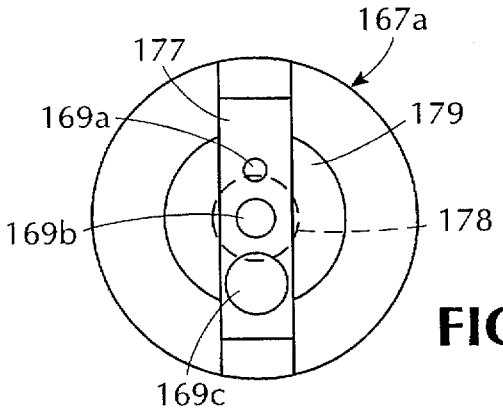

For example, referring to FIG. 14A, the size of the aperture 169 may be adjusted in lieu of or in addition to adjusting the length of the optical path. As shown in FIG. 14A, a slide 177 with different diameter apertures 169*a*, 169*b*, 169*c* has been added to the end 179 of tubular section 167*a* which has an opening 178 of diameter equal to or larger than that of the largest aperture 169*c*. Detents (not shown) are provided to engage the slide 177 in positions aligning an aperture 169*a*, 169*b*, 169*c* with the optical axis 170. Shutter mechanisms and other known mechanisms may be used to change the size of the aperture 169 which admits light into the optical system 165.

Referring to FIGS. 6 and 16, the optical system 180 for the self-propelled target 16 comprises an aperture 181 in the top 182 of the target housing 17 and a fixed length light passage referenced generally by 184 formed by baffles 185 depending from the top 182. The IR light receiver 56 is attached to a bracket 187 with the IR detector element 175 between the baffles 185 facing the aperture 181. The bracket 187 is connected to the top 182 by screws 188 threaded into posts 189 depending from the top 182. The aperture 181 is relatively small so that "hitting" the self-propelled target will not be too easy.

Gun Switches

Referring to FIG. 17, the trigger switch 70 is mounted to a bracket 190 extending from one side 13*a* of the gun housing 13, and has a switch plunger 74 activated by a rib 192 on the pivotally mounted trigger 73. The trigger 73 has parallel side walls 193, a front wall 194 and a bottom wall 195 which define a space 196 therebetween. The trigger 73 has aligned holes 197 in the sidewalls 193 through which passes a shaft 198 fixed to the side 13*a* of the gun housing 13. The holes 197 are sized to permit the trigger 73 to pivot on the shaft 198. A hair spring 199 is wound around the shaft 198, with one end bearing against a retainer 200 in the front wall 194 and the other anchored on a post 201 fixed to the side 13*a* of the gun housing 13. The trigger 73 is biased away from the switch plunger 74 by the spring 199. Pivoting the trigger 73 against the action of the spring 199 causes the rib 192 to contact and depress the switch plunger 74.

Referring to FIG. 18, the reload switch 71 is mounted to a printed circuit board 210 mounted to the side 13*a* of the gun housing 13 by screws 212 threaded to posts 213 connected to the gun housing side 13*a*. The reload button 76 is mounted in a hole 214 in the side 13*a* of the gun housing 13. The reload button 76 is larger than the hole 214 and has a rib 215 about its periphery which retains the reload button 76 in the hole 214. The reload button 76 has a projecting post 216 contacting the switch plunger 75 to prevent the reload button 71 from falling into the gun. Pressing the reload button 71 depresses the switch plunger 75 which is spring loaded and thereby spring loads the reload button 71.

While the invention has been described and illustrated in connection with preferred embodiments, many variations and modifications, as will be evident to those skilled in this art, may be made without departing from the spirit and scope of the invention. For example, more than two types of player-worn targets may be provided and more than one type of self-propelled target may be provided. In addition to vest targets for the chest and back, player-worn targets may be provided for the player's limbs. Also different types of self-propelled targets may be provided, and these targets may interact or cooperate in different ways. Different light coding and modulation may be provided e.g., digital coding, frequency modulation, pulse position coding, etc. Mechanisms other than those disclosed herein may be used to adjust game difficulty, including changing the sensitivity of the IR light detector or the response of the electrical circuitry, etc. Also, the differently coded light projected by a toy light gun may be used in a target for functions other than those disclosed herein. The invention as set forth in the appended claims is thus not to be limited to the precise details of construction set forth above as such variations and modifications are intended to be included within the spirit and scope of the invention as defined in the appended claims.

We claim:

1. A toy light projector used in a toy shooting game, comprising:

a housing;

a light source carried by said housing positioned to project light therefrom;

an electrical circuit carried by said housing coupled to said light source which controls energization of said light source according to a selectable code and thereby causes said light source to emit light with the selected code;

a first manually actuatable trigger control carried by said housing coupled to said electrical circuit;

a second manually actuatable control carried by said housing coupled to said electrical circuit;

said electrical circuit controlling energization of said light source according to a first code representing a firing of said toy light projector in response to activation of said first control to cause said light source to emit light with said first code, and controlling energization of said light source according to a second code in response to activation of said second control to cause said light source to emit light with said second code;

said electrical circuit comprising a modulating circuit which modulates energization of said light source during a first time period corresponding to said first code in response to activation of said first control and during a second time period corresponding to said second code in response to activation of said second control.

2. The toy light projector of claim 1 wherein said first trigger control when activated without activation of said second control causes said toy light projector to project light with said first code, and wherein said second control when activated without activation of said first control causes said toy light projector to project light with said second code.

3. A toy light projector used in a toy shooting game, comprising:

a housing;

a light source carried by said housing positioned to project light therefrom;

an electrical circuit carried by said housing coupled to said light source which controls energization of said light source according to a selectable code and thereby causes said light source to emit light with the selected code;

a sound generating device carried by said housing to emit sound therefrom responsive to electrical sound signals supplied thereto;

first and second manually actuatable controls carried by said housing coupled to said electrical circuit;

said electrical circuit controlling energization of said light source according to first and second codes selected by and in response to activation of said first and second controls, respectively, and providing first and second electrical sound signals representing first and second sounds or sequence of sounds to said sound generating device in response to activation of said first and second controls, respectively.

4. A toy light projector used in a toy shooting game, comprising:

a housing;

a light source carried by said housing positioned to project light therefrom;

first and second manually actuatable controls carried by said housing;

a sound generating device carried by said housing to emit sound therefrom responsive to electrical sound signals supplied thereto;

an electrical circuit carried by said housing coupled to said light source and to said first and second controls which controls energization of said light source in response to activation of said first and second controls, said electrical circuit being responsive to activation of said first control up to a preset number of times causing said light source for each activation to emit light having a predetermined characteristic or characteristics up to said preset number of times, said electrical circuit not energizing said light source to emit light in response to further activations of said first control, said electrical circuit in response to activation of said second control allowing said light source to be energized and emit light in response to activations of said first control up to said preset number;

said electrical circuit providing first and second electrical sounds signals representing first and second sounds or sequences of sounds to said sound generating device in response to activation of said first and second controls, respectively.

5. The light projector of claim 4, wherein said second signal causes said sound generating device to emit a gun reloading sound.

6. A toy light projector for projecting coded light used in a toy shooting game which includes a toy target that detects and decodes coded light received from said light projector to register hits and to reset the target, comprising:

a housing;

a light source carried by said housing positioned to project light therefrom;

an electrical circuit carried by said housing coupled to said light source which controls energization of said light source according to a selectable code, and thereby causes said light source to emit light according to the selected code;

a sound generating device carried by said housing to emit sound therefrom responsive to electrical sound signals supplied thereto;

first and second manually actuatable controls carried by said housing coupled to said electrical circuit;

said electrical circuit (a) controlling energization of said light source according to a first code adapted to identify a firing of said light projector which when processed by the toy target can be registered as a hit in response to activation of said first control, and controlling energization of said light source according to a second code adapted when processed by the toy target to remotely reset the toy target in response to activation of said second control, and (b) providing first and second electrical sound signals representing first and second sounds or sequence of sounds to said sound generating device in response to activation of said first and second controls, respectively.

7. A toy light projector for projecting coded light used in a toy shooting game with a toy target that detects and decodes coded light received from said light projector to register hits and perform at least one other game function, comprising:

a housing;

a light source carried by said housing positioned to project light therefrom;

an electrical circuit carried by said housing coupled to said light source which controls energization of said light source according to a selectable code and thereby causes said light source to emit light according to the selected code;

a sound generating device carried by said housing to emit sound therefrom responsive to electrical sound signals supplied thereto;

first and second manually actuatable controls carried by said housing coupled to said electrical circuit;

said electrical circuit (a) controlling energization of said light source according to a first code adapted to identify a firing of said light projector which when processed by the toy target can be registered as a hit in response to activation of said first control, and controlling energization of said light source according to a second code adapted when processed by the toy target to cause the toy target to perform the at least one other game function in response to activation of said second control, and (b) providing first and second electrical sound signals representing first and second sounds or sequence of sounds to said sound generating device in response to activation of said first and second controls, respectively.

8. A toy light projector for projecting coded light used in a toy shooting game which includes a toy target that detects and decodes coded light received from said light projector to register hits and to reset the target for the start of another game or competition, comprising:

a housing;

a light source carried by said housing positioned to project light therefrom;

an electrical circuit carried by said housing coupled to said light source which controls energization of said light source according to a first selectable code adapted to identify a firing of said light projector which when processed by the toy target can be registered as a hit, and a second selectable code adapted when processed by the toy target to remotely reset the toy target for the start of another game or competition, and which causes said light source to emit light according to the selected code;

first and second manually actuatable controls carried by said housing coupled to said electrical circuit;

said electrical circuit controlling energization of said light source according to said first and second codes selected by and in response to activation of said first and second controls, respectively.

9. The toy light projector of claim 1, 2, 4, 6, 7 or 8 wherein said light source emits infrared light when energized by said electrical circuit.

10. The toy light projector of claim 1, 2, 3, 6, 7 or 8 comprising structure associated with said housing defining a light-transmitting aperture positioned to project light emitted by said light source from said toy light projector.

11. The toy light projector of claim 10 comprising an optical system having a lens positioned between said light transmitting aperture and said light source.

12. The toy light projector of claim 2, 6 or 7 wherein said electrical circuit comprises a sound synthesizer which supplies said first and second electrical sound signals.

13. The toy light projector of claim 2, 6, 7 or 8 wherein said electrical circuit comprises a modulating circuit which modulates energization of said light source during a first time period corresponding to said first code in response to activation of said first control and during a second time period corresponding to said second code in response to activation of said second control.

14. The toy light projector of claim 13 wherein said modulating circuit modulates energization of said light source at a fixed frequency.

15. The toy light projector of claim 13 wherein said electrical circuit comprises a control circuit coupled to said first and second controls and to said modulation circuit, said control circuit causing said modulating circuit to modulate energization of said light source for the first and second time periods.

16. The toy light projector of claim 15 wherein said control circuit causes said modulating circuit to modulate energization of said light source during the first time period for up to a preset number of activations of said first control and thereafter to not modulate energization of said light source during the first time period, said toy light projector comprising a third control coupled to said control circuit, said control circuit causing said modulation circuit to modulate energization of said light source during the first time period for up to the preset number of first control activations in response to activation of said third control.

17. A self-propelled light detecting toy comprising:

a housing;

a light detector carried by said housing positioned to receive coded pulses of light projected at said light detecting toy, said light detector detecting said coded light pulses and providing electrical signals in response thereto;

at least one indicator coupled to be responsive to said electrical signals to indicate detection of light pulses by said light detector;

a reversible electric motor and at least one wheel coupled thereto on which said housing rides mounted to rotate in opposite directions, said at least one wheel being driven in opposite directions by said motor to propel said light detecting toy; and an electrical circuit including a programmed processor and a drive circuit, said programmed processor providing control signals to said drive circuit in accordance with a programmed sequence of direction reversals, and said drive circuit being coupled to said motor to energize said motor to selectively rotate said at least one wheel in opposite directions in accordance with said control signals.

18. The light detecting toy of claim 17 comprising a non-driven wheel on which said housing rides, said non-driven wheel being mounted to an axle, said housing having a track along which at least one end of said axle is free to translate, whereby said non-driven wheel non-linearly translates in response to translation of said axle in said track and thereby affects the path of motion of said light detecting toy in response to one or more of the terrain on which say light detecting toy rides, obstacles encountered by said light detecting toy and direction reversals of said at least one driven wheel.

19. A light detecting toy comprising:

a housing;

a light detector carried by said housing positioned to receive light projected at said light detecting toy, said light detector detecting first and second coded pulses of light received thereby and providing first and second electrical signals, respectively, in response thereto;

an electrical circuit coupled to receive said first and second electrical signals provided by said light detector and count said first electrical signals, and in response to a second electrical signal provided by said light detector reset a count of said first electrical signals.

20. The light detecting toy of claim 19 wherein said electrical circuit counts first electrical signals up to a preset number and thereafter does not count further first electrical signals until said count is reset in response to a second electrical signal.

21. The light detecting toy of claim 20 comprising a sound generating device carried by said housing to emit sound therefrom responsive to first and second electrical sound signals supplied thereto, said electrical circuit generating said first electrical sound signals representing a first sound or sequence of sounds with each count of a first electrical signal, and generating said second sound electrical signal representing a second sound or sequence of sounds with each reset of said count responsive to a second electrical signal.

22. The light detecting toy of claim 21 wherein said electrical circuit comprises a sound synthesizer and said sound generating device comprises a speaker.

23. A light detecting toy used in a toy shooting game, comprising:

a housing;

a light detector carried by said housing positioned to receive light projected at said light detecting toy from a light projecting toy used in the toy shooting game, said light detector detecting first and second coded pulses of light received thereby and providing first and second electrical signals, respectively, in response thereto;

an electrical circuit coupled to receive said first and second electrical signals provided by said light detector and count said first electrical signals, and in response to a second electrical signal provided by said light detector cause at least one other game function to be performed.

24. The light detecting toy of claim 19 or 23 wherein said light detector comprises an infrared light detector.

25. The light detecting toy of claim 19 or 33 wherein said light detector detects pulses of light that are amplitude modulated at a given frequency.

26. The light detecting toy of claim 25 wherein said first and second coded light pulses have different pulse widths by which said first and second light pulses are coded, said light detector providing a first electrical pulse signal in response to a detected first coded light pulse and a second electrical pulse signal in response to a detected second coded light pulse, said first and second electrical pulse signals having different pulse widths related to the pulse widths of said first and second light pulses, respectively.

27. The light detecting toy of claim 19 or 23 comprising an electric motor and at least one wheel carried by said housing on which said housing rides, said at least one wheel being driven by said motor to propel said light detecting toy, and wherein said electrical circuit includes a drive circuit coupled to said motor to energize said motor.

28. The light detecting toy of claim 27 wherein said electrical motor is reversible and said drive circuit is configured and coupled to said motor to cause said motor to reverse direction in accordance with a sequence controlled by said electrical circuit.

29. The light detecting toy of claim 20 wherein said electrical circuit includes a programmed processor which provides signals to said drive circuit in accordance with a programmed sequence.

30. The light detecting toy of claim 19 or 23 comprising structure associated with said housing defining a light-transmitting aperture positioned to transmit to said light detector light projected at said light detecting toy.

31. A toy shooting game comprising a toy light projector and a light detecting toy, said toy light projector comprising:

a housing;

a light source carried by said housing positioned to project light therefrom;

an electrical circuit carried by said housing coupled to said light source which energizes said light source to emit coded pulses of light which are projected from said housing;

first and second manually actuatable controls carried by said housing coupled to said electrical circuit;

said electrical circuit energizing said light source according to first and second codes in response to activation of said first and second controls, respectively, and in response thereto said light source emits first and second coded pulses of light, respectively;

said light detecting toy comprising:

a housing;

a light detector carried by said housing positioned to receive first and second coded pulses of light emitted by said toy light projector and projected at said light detecting toy, said light detector detecting said first and second coded pulses of light and providing first and second electrical signals, respectively, in response thereto;

an electrical circuit coupled to receive said first and second electrical signals provided by said light detector and count said first electrical signals, and in response to said second electrical signals provided by said light detector reset a count of said first electrical signals.

32. The combination of claim 31 wherein said light detector provides a first electrical signal in response to a first coded light pulse and a second electrical signal in response to a second coded light pulse, and wherein said electrical circuit of said light detector counts first electrical signals up to a preset number and thereafter does not count further first electrical signals until said count is reset in response to a second electrical signal.

33. The light detecting toy of claim 31 comprising a sound generating device carried by said housing to emit sound therefrom responsive to first and second electrical sound signals supplied thereto, said electrical circuit of said toy light detector generating said first electrical sound signals representing a first sound or sequence of sounds with each count of a first electrical signal, and generating said second sound electrical signal representing a second sound or sequence of sounds with each reset of said count responsive to a second electrical signal.

34. The combination of claim 33 wherein said light detector detects pulses of light that are amplitude modulated at a given frequency.

35. A toy shooting game comprising a toy light projector and a light detecting toy, said toy light projector comprising:

a housing;

a light source carried by said housing positioned to project light therefrom;

an electrical circuit carried by said housing coupled to said light source which energizes said light source to emit coded pulses of light which are projected from said housing;

first and second manually actuatable controls carried by said housing coupled to said electrical circuit;

said electrical circuit energizing said light source according to first and second codes in response to activation of said first and second controls, respectively, and in response thereto said light source emits first and second coded pulses of light, respectively;

said light detecting toy comprising:

a housing;

a light detector carried by said housing positioned to receive first and second coded pulses of light emitted by said toy light projector which are projected at said light detecting toy, said light detector detecting said first and second coded pulses of light and providing first and second electrical signals, respectively, in response thereto;

an electrical circuit coupled to receive said first and second electrical signals provided by said light detector and count said first electrical signals, and in response to said second electrical signals provided by said light detector cause at least one other game function to be performed.

36. The combination of claim 35 wherein said light source emits infrared light when energized by said electrical circuit.

37. The combination of claim 31 or 35 wherein said electrical circuit of said toy light projector comprises a modulating circuit which modulates energization of said light source during a first time period in response to activation of said first control and during a second time period in response to activation of said second control.

38. The combination of claim 37 wherein said modulating circuit modulates energization of said light source at a fixed frequency.

39. The combination of claim 37 wherein said electrical circuit of said toy light projector comprises a control circuit coupled to said first and second controls and to said modulation circuit, said control circuit causing said modulating circuit to modulate energization of said light source for the first and second time periods.

* * * * *

UNITED STATES PATENT AND TRADEMARK OFFICE

CERTIFICATE OF CORRECTION

PATENT NO. : 5,741,185

DATED : April 21,1998

INVENTOR(S) : David Chu Ki Kwan et al.

It is certified that error appears in the above-indentified patent and that said Letters Patent is hereby corrected as shown below:

Column 6, line 66, "pan" should read --part--;

Column 7, line 45, between "circuit" and ")", insert --"--;

Column 7, line 55, after "46", insert --"--;

Column 10, lines 20-21, "thor-ough" should read --through--;

Column 11, line 27, "Khz" should read --KHz--;

Column 14, line 16, after "target 16", delete ")";

Column 14, line 17, "alighted" should read "aligned";

Column 15, line 34, ":" should read --,--;

Column 15, line 54, "fiat" should read --flat--;

Column 19, line 2, "sounds" should read --sound--;

UNITED STATES PATENT AND TRADEMARK OFFICE

CERTIFICATE OF CORRECTION

PATENT NO. : 5,741,185

DATED : April 21, 1998

INVENTOR(S) : David Chu Ki Kwan et al.

It is certified that error appears in the above-indentified patent and that said Letters Patent is hereby corrected as shown below:

Column 20, line 34, "3" should read --4--;

Column 21, line 33, "say" should read --said--;

Column 22, line 19, "33" should read --23--;

Column 22, line 42, "20" should read --28--;

Column 24, line 25, after "claim", insert --31 or--.

Signed and Sealed this

Fifteenth Day of September, 1998

*Attest:*

Bruce Lehman

BRUCE LEHMAN

*Attesting Officer*

*Commissioner of Patents and Trademarks*